US010653180B2

(12) United States Patent
Monsees et al.

(10) Patent No.: US 10,653,180 B2
(45) Date of Patent: May 19, 2020

(54) MULTIPLE HEATING ELEMENTS WITH SEPARATE VAPORIZABLE MATERIALS IN AN ELECTRIC VAPORIZATION DEVICE

(71) Applicant: JUUL Labs, Inc., San Francisco, CA (US)

(72) Inventors: James Monsees, San Francisco, CA (US); Adam Bowen, San Mateo, CA (US)

(73) Assignee: Juul Labs, Inc., San Francisco, CA (US)

( * ) Notice: Subject to any disclaimer, the term of this patent is extended or adjusted under 35 U.S.C. 154(b) by 1002 days.

(21) Appl. No.: 14/304,847

(22) Filed: Jun. 13, 2014

(65) Prior Publication Data

US 2014/0366898 A1 Dec. 18, 2014

Related U.S. Application Data

(60) Provisional application No. 61/835,458, filed on Jun. 14, 2013.

(51) Int. Cl.
*A24F 47/00* (2020.01)

(52) U.S. Cl.
CPC ..... *A24F 47/008* (2013.01)

(58) Field of Classification Search
None
See application file for complete search history.

(56) References Cited

U.S. PATENT DOCUMENTS 374,584 A 12/1887 Cook
576,653 A 2/1897 Bowlby
595,070 A 12/1897 Oldenbusch
799,844 A 9/1905 Fuller
968,160 A 8/1910 Johnson
969,076 A 8/1910 Fender
1,067,531 A 7/1913 MacGregor
1,163,183 A 12/1915 Stow
1,299,162 A 4/1919 Fisher
1,505,748 A 8/1924 Louis
1,552,877 A 9/1925 Phillipps et al.
1,632,335 A 6/1927 Hiering
1,706,244 A 3/1929 Louis
1,845,340 A 2/1932 Ritz
(Continued)

FOREIGN PATENT DOCUMENTS

CA 2641869 A1 5/2010
CN 85106876 A 9/1986
(Continued)

OTHER PUBLICATIONS

U.S. Appl. No. 13/587,416 Office Action dated Feb. 2, 2015.
(Continued)

*Primary Examiner* — Paul S Hyun

(74) *Attorney, Agent, or Firm* — Mintz Levin Cohn Ferris Glovsky and Popeo, P.C.

(57) ABSTRACT

A cartridge for use with a vaporization device comprising a first heating element, a first compartment for containment of a first vaporizable material, and a second compartment for containment of a second vaporizable material, wherein the device generates an aerosol for inhalation by a subject by heating the first vaporizable material or the second vaporizable material.

29 Claims, 8 Drawing Sheets

(56) References Cited

U.S. PATENT DOCUMENTS 1,972,118 A 9/1934 McDill
1,998,683 A 4/1935 Montgomery
2,031,363 A 2/1936 Elof
2,039,559 A 5/1936 Segal
2,104,266 A 1/1938 McCormick
2,159,698 A 5/1939 Harris et al.
2,177,636 A 10/1939 Coffelt et al.
2,195,260 A 3/1940 Rasener
2,231,909 A 2/1941 Hempel
2,327,120 A 8/1943 McCoon
2,460,427 A 2/1949 Musselman et al.
2,483,304 A 9/1949 Rudolf
2,502,561 A 4/1950 Ludwig
2,765,949 A 10/1956 Swan
2,830,597 A 4/1958 Kummli
2,860,638 A 11/1958 Bartolomeo
2,897,958 A 8/1959 Tarleton et al.
2,935,987 A 5/1960 Ackerbauer
3,146,937 A 9/1964 Joseph
3,258,015 A 6/1966 Ellis et al.
3,271,719 A 9/1966 Ovshinsky
3,292,634 A 12/1966 Beucler
3,373,915 A 3/1968 Anderson et al.
3,420,360 A 1/1969 Young
3,443,827 A 5/1969 Acker et al.
3,456,645 A 7/1969 Brock
3,479,561 A 11/1969 Janning
3,567,014 A 3/1971 Feigelman
3,675,661 A 7/1972 Weaver
3,707,017 A 12/1972 Paquette
3,792,704 A 2/1974 Parker
3,815,597 A 6/1974 Gottelman
3,861,523 A 1/1975 Fountain et al.
3,941,300 A 3/1976 Troth
4,020,853 A 5/1977 Nuttal
4,049,005 A 9/1977 Hernandez et al.
4,066,088 A 1/1978 Ensor
4,207,976 A 6/1980 Herman
4,215,708 A 8/1980 Bron
4,219,032 A 8/1980 Tabatznik et al.
4,303,083 A 12/1981 Burruss
4,506,683 A 3/1985 Cantrell et al.
4,519,319 A 5/1985 Howlett
4,520,938 A 6/1985 Finke
4,595,024 A 6/1986 Greene et al.
4,648,393 A 3/1987 Landis et al.
4,708,151 A 11/1987 Shelar
4,735,217 A 4/1988 Gerth et al.
4,771,796 A * 9/1988 Myer ..... A24F 47/002 131/273
4,793,365 A 12/1988 Sensabaugh, Jr. et al.
4,794,323 A 12/1988 Zhou et al.
4,798,310 A 1/1989 Kasai et al.
4,813,536 A 3/1989 Willis
4,819,665 A 4/1989 Roberts et al.
4,830,028 A 5/1989 Lawson et al.
4,836,224 A 6/1989 Lawson et al.
4,846,199 A 7/1989 Rose
4,848,374 A 7/1989 Chard et al.
4,848,563 A 7/1989 Robbins
4,893,639 A 1/1990 White
4,907,606 A 3/1990 Lilja et al.
4,941,483 A 7/1990 Ridings
4,944,317 A 7/1990 Thal
4,947,874 A 8/1990 Brooks et al.
4,947,875 A 8/1990 Brooks et al.
5,005,759 A 4/1991 Bouche
5,020,548 A 6/1991 Farrier et al.
5,027,836 A 7/1991 Shannon et al.
5,031,646 A 7/1991 Lippiello et al.
5,050,621 A 9/1991 Creighton et al.
5,060,671 A 10/1991 Counts et al.
5,065,776 A 11/1991 Lawson et al.
5,076,297 A 12/1991 Farrier et al.
5,105,831 A 4/1992 Banerjee et al.
5,105,838 A 4/1992 White et al.
5,123,530 A 6/1992 Lee
5,133,368 A 7/1992 Neumann et al.
5,144,962 A 9/1992 Counts et al.
5,152,456 A 10/1992 Ross et al.
720,007 A 2/1993 Dexter
5,183,062 A 2/1993 Clearman et al.
5,224,498 A 7/1993 Deevi et al.
5,240,012 A 8/1993 Ehrman et al.
5,249,586 A 10/1993 Morgan et al.
5,261,424 A * 11/1993 Sprinkel, Jr. ..... A24F 47/008 128/202.21
5,269,237 A 12/1993 Baker et al.
5,269,327 A 12/1993 Counts et al.
5,303,720 A 4/1994 Banerjee et al.
5,322,075 A 6/1994 Deevi et al.
5,324,498 A 6/1994 Streusand et al.
5,372,148 A 12/1994 McCafferty et al.
5,388,574 A 2/1995 Ingebrethsen
5,449,078 A 9/1995 Akers
5,456,269 A 10/1995 Kollasch
5,497,791 A 3/1996 Bowen et al.
5,529,078 A 6/1996 Rehder et al.
5,579,934 A 12/1996 Buono
5,591,368 A 1/1997 Fleischhauer et al.
5,605,226 A 2/1997 Hernlein
5,641,064 A 6/1997 Goserud
5,649,552 A 7/1997 Cho et al.
5,666,977 A 9/1997 Higgins
5,666,978 A 9/1997 Counts et al.
5,708,258 A 1/1998 Counts et al.
5,730,118 A 3/1998 Hermanson
5,730,158 A 3/1998 Collins et al.
5,746,587 A 5/1998 Racine et al.
5,810,164 A 9/1998 Rennecamp
5,819,756 A 10/1998 Mielordt
5,845,649 A 12/1998 Saito et al.
5,865,185 A 2/1999 Collins et al.
5,881,884 A 3/1999 Podosek
5,931,828 A 8/1999 Durkee
5,934,289 A 8/1999 Watkins et al.
5,938,018 A 8/1999 Keaveney et al.
5,944,025 A 8/1999 Cook et al.
5,994,025 A 8/1999 Cook et al.
5,954,979 A 9/1999 Counts et al.
5,967,310 A 10/1999 Hill
5,975,415 A 11/1999 Zehnal
5,979,460 A 11/1999 Matsumura
5,996,589 A 12/1999 St. Charles
6,053,176 A 4/2000 Adams
6,089,857 A 7/2000 Matsuura et al.
6,095,153 A 8/2000 Kessler et al.
6,102,036 A 8/2000 Slutsky et al.
6,125,853 A 10/2000 Susa et al.
6,155,268 A 12/2000 Takeuchi
6,164,287 A 12/2000 White
6,196,232 B1 3/2001 Chkadua
6,234,169 B1 5/2001 Bulbrook et al.
6,269,966 B1 8/2001 Pallo et al.
6,324,261 B1 11/2001 Merte
6,349,728 B1 2/2002 Pham
6,381,739 B1 4/2002 Breternitz, Jr. et al.
6,386,371 B1 5/2002 Parsons
6,431,363 B1 8/2002 Hacker
6,446,793 B1 9/2002 Layshock
6,510,982 B2 1/2003 White et al.
6,532,965 B1 3/2003 Abhulimen et al.
6,536,442 B2 3/2003 St. Charles et al.
6,557,708 B2 5/2003 Polacco
6,598,607 B2 7/2003 Adiga et al.
6,603,924 B2 8/2003 Brown et al.
6,606,998 B1 8/2003 Gold
6,612,404 B2 9/2003 Sweet et al.
6,615,840 B1 9/2003 Fournier et al.
6,622,867 B2 9/2003 Menceles
6,655,379 B2 12/2003 Clark et al.
6,672,762 B1 1/2004 Faircloth et al.
6,688,313 B2 2/2004 Wren et al.
6,726,006 B1 4/2004 Funderburk et al.

(56) References Cited

U.S. PATENT DOCUMENTS 6,772,756 B2 8/2004 Shayan
6,799,576 B2 10/2004 Farr
6,803,545 B2 10/2004 Blake et al.
6,805,545 B2 10/2004 Slaboden
6,810,883 B2 11/2004 Felter et al.
6,827,573 B2 12/2004 St. Charles et al.
6,954,979 B2 10/2005 Logan
7,000,775 B2 2/2006 Gelardi et al.
7,015,796 B2 3/2006 Snyder
7,434,584 B2 10/2008 Steinberg
7,488,171 B2 2/2009 St. Charles et al.
D590,990 S 4/2009 Hon
D590,991 S 4/2009 Hon
7,546,703 B2 6/2009 Johnske et al.
7,621,403 B2 11/2009 Althoff et al.
7,644,823 B2 1/2010 Gelardi et al.
7,767,698 B2 8/2010 Warchol et al.
D624,238 S 9/2010 Turner
7,801,573 B2 9/2010 Yazdi et al.
7,815,332 B1 10/2010 Smith
7,832,410 B2 11/2010 Hon
7,886,507 B2 2/2011 McGuinness, Jr.
D642,330 S 7/2011 Turner
D644,375 S 8/2011 Zhou et al.
7,988,034 B2 8/2011 Pezzoli
D653,803 S 2/2012 Timmermans
8,141,701 B2 3/2012 Hodges
8,156,944 B2 4/2012 Hon
8,251,060 B2 8/2012 White et al.
8,322,350 B2 12/2012 Lipowicz
8,371,310 B2 2/2013 Brenneise
8,381,739 B2 2/2013 Gonda
8,387,612 B2 3/2013 Damani et al.
8,443,534 B2 5/2013 Goodfellow et al.
8,490,629 B1 7/2013 Shenassa et al.
8,511,318 B2 8/2013 Hon
8,539,959 B1 9/2013 Scatterday
8,541,401 B2 9/2013 Mishra et al.
D691,324 S 10/2013 Saliman
D695,450 S 12/2013 Benassayag et al.
8,596,460 B2 12/2013 Scatterday
8,671,952 B2 3/2014 Winterson et al.
D707,389 S 6/2014 Liu
8,741,348 B2 6/2014 Hansson et al.
8,809,261 B2 8/2014 Elsohly et al.
8,820,330 B2 9/2014 Bellinger et al.
8,851,081 B2 10/2014 Fernando et al.
8,881,737 B2 11/2014 Collett et al.
8,915,254 B2 12/2014 Monsees et al.
8,925,555 B2 1/2015 Monsees et al.
D725,310 S 3/2015 Eksouzian
8,991,402 B2 3/2015 Monsees et al.
9,095,175 B2 8/2015 Terry et al.
9,215,895 B2 12/2015 Bowen et al.
9,220,302 B2 12/2015 DePiano et al.
9,226,526 B2 1/2016 Liu
9,271,525 B2 3/2016 Liu
9,271,529 B2 3/2016 Alima
9,272,103 B2 3/2016 Storz
9,277,769 B2 3/2016 Liu
9,282,772 B2 3/2016 Tucker et al.
9,282,773 B2 3/2016 Greim et al.
9,289,014 B2 3/2016 Tucker et al.
9,301,547 B2 4/2016 Liu
9,308,336 B2 4/2016 Newton
9,326,547 B2 5/2016 Tucker et al.
9,351,522 B2 5/2016 Safari
2001/0015209 A1 8/2001 Zielke
2001/0032643 A1 10/2001 Hochrainer et al.
2001/0032795 A1 10/2001 Weinstein et al.
2001/0052480 A1 12/2001 Kawaguchi et al.
2002/0078951 A1 6/2002 Nichols et al.
2002/0146242 A1 10/2002 Vieira
2002/0175164 A1 11/2002 Dees et al.
2003/0005926 A1 1/2003 Jones et al.
2003/0089377 A1 5/2003 Hajaligol et al.
2003/0150451 A1 8/2003 Shayan
2003/0154991 A1 8/2003 Fournier et al.
2004/0050382 A1 3/2004 Goodchild
2004/0099266 A1 5/2004 Cross et al.
2004/0149296 A1 8/2004 Rostami et al.
2004/0149624 A1 8/2004 Wischusen et al.
2004/0173229 A1 9/2004 Crooks et al.
2004/0182403 A1 9/2004 Andersson et al.
2004/0221857 A1 11/2004 Dominguez
2004/0237974 A1 12/2004 Min
2005/0016549 A1 1/2005 Banerjee et al.
2005/0016550 A1 1/2005 Katase
2005/0034723 A1 2/2005 Bennett et al.
2005/0061759 A1 3/2005 Doucette
2005/0069831 A1 3/2005 St. Charles et al.
2005/0090798 A1 4/2005 Clark et al.
2005/0118545 A1 6/2005 Wong
2005/0145533 A1 7/2005 Seligson
2005/0172976 A1 8/2005 Newman et al.
2005/0244521 A1 11/2005 Strickland et al.
2005/0268911 A1 12/2005 Cross et al.
2006/0018840 A1 1/2006 Lechuga Ballesteros et al.
2006/0054676 A1 3/2006 Wischusen
2006/0102175 A1 5/2006 Nelson
2006/0150991 A1 7/2006 Lee
2006/0191546 A1 8/2006 Takano et al.
2006/0191548 A1 8/2006 Strickland et al.
2006/0196518 A1 9/2006 Hon
2006/0254948 A1 11/2006 Herbert et al.
2006/0255105 A1 11/2006 Sweet
2007/0006889 A1 1/2007 Kobal et al.
2007/0045288 A1 3/2007 Nelson
2007/0062548 A1 3/2007 Horstmann et al.
2007/0074734 A1 4/2007 Braunshteya et al.
2007/0098148 A1 5/2007 Sherman
2007/0102013 A1 5/2007 Adams et al.
2007/0144514 A1 6/2007 Yeates et al.
2007/0163610 A1 7/2007 Lindell et al.
2007/0215164 A1 9/2007 Mehio
2007/0235046 A1 10/2007 Gedevanishvili
2007/0267033 A1 11/2007 Mishra et al.
2007/0277816 A1 12/2007 Morrison et al.
2007/0280652 A1 12/2007 Williams
2007/0283972 A1 12/2007 Monsees et al.
2008/0000763 A1 1/2008 Cove
2008/0023003 A1 1/2008 Rosenthal
2008/0029095 A1 2/2008 Esser
2008/0092912 A1 4/2008 Robinson et al.
2008/0149118 A1 6/2008 Oglesby et al.
2008/0216828 A1 9/2008 Wensley et al.
2008/0241255 A1 10/2008 Rose et al.
2008/0257367 A1 10/2008 Paterno et al.
2008/0276947 A1 11/2008 Martzel
2009/0004249 A1 1/2009 Gonda
2009/0095287 A1 4/2009 Emarlou
2009/0111287 A1 4/2009 Lindberg et al.
2009/0126745 A1 5/2009 Hon
2009/0133691 A1 5/2009 Yamada et al.
2009/0133703 A1 5/2009 Strickland et al.
2009/0133704 A1 5/2009 Strickland et al.
2009/0151717 A1 6/2009 Bowen
2009/0230117 A1 9/2009 Fernando et al.
2009/0255534 A1 10/2009 Paterno
2009/0260641 A1 10/2009 Monsees
2009/0260642 A1 10/2009 Monsees
2009/0267252 A1 10/2009 Ikeyama
2009/0272379 A1 11/2009 Thorens
2009/0283103 A1 11/2009 Nielsen et al.
2009/0288668 A1 11/2009 Inagaki
2009/0288669 A1 11/2009 Hutchens
2009/0293892 A1 12/2009 Williams et al.
2009/0293895 A1 12/2009 Axelsson et al.
2009/0314299 A1* 12/2009 Kilpatrick ..... A24F 13/10 131/187
2010/0000672 A1 1/2010 Fogle
2010/0006092 A1 1/2010 Hale
2010/0024834 A1 2/2010 Oglesby et al.
2010/0031968 A1 2/2010 Sheikh

(56) References Cited

U.S. PATENT DOCUMENTS

2010/0156193 A1 6/2010 Rhodes et al.
2010/0163063 A1 7/2010 Fernando et al.
2010/0186757 A1 7/2010 Crooks et al.
2010/0200008 A1 8/2010 Taieb
2010/0236562 A1 9/2010 Hearn et al.
2010/0242974 A1 9/2010 Pan
2010/0242976 A1 9/2010 Katayama
2010/0275938 A1 11/2010 Roth et al.
2010/0276333 A1 11/2010 Couture
2010/0307116 A1 12/2010 Fisher
2010/0313901 A1* 12/2010 Fernando ..... A24F 47/008 131/330
2011/0030706 A1 2/2011 Gibson et al.
2011/0036346 A1 2/2011 Cohen et al.
2011/0041861 A1 2/2011 Sebastian et al.
2011/0049226 A1 3/2011 Moreau et al.
2011/0094523 A1 4/2011 Thorens et al.
2011/0108023 A1 5/2011 McKinney
2011/0155153 A1 6/2011 Thorens et al.
2011/0162667 A1 7/2011 Burke et al.
2011/0180433 A1 7/2011 Rennecamp
2011/0192397 A1 8/2011 Saskar et al.
2011/0226236 A1 9/2011 Buchberger
2011/0226266 A1 9/2011 Tao
2011/0232654 A1 9/2011 Mass
2011/0236002 A1 9/2011 Oglesby et al.
2011/0240047 A1 10/2011 Adamic
2011/0265806 A1 11/2011 Alarcon et al.
2011/0268809 A1 11/2011 Brinkley et al.
2011/0277780 A1 11/2011 Terry et al.
2011/0278189 A1 11/2011 Terry et al.
2011/0315701 A1 12/2011 Everson
2012/0006342 A1 1/2012 Rose et al.
2012/0048266 A1 3/2012 Alelov
2012/0111347 A1 5/2012 Hon
2012/0199146 A1 8/2012 Marangos
2012/0204889 A1 8/2012 Xiu
2012/0227753 A1 9/2012 Newton
2012/0247494 A1 10/2012 Oglesby et al.
2012/0255567 A1 10/2012 Rose et al.
2012/0260927 A1 10/2012 Liu
2012/0267383 A1 10/2012 Van Rooyen
2012/0285475 A1 11/2012 Liu
2012/0325227 A1 12/2012 Robinson et al.
2013/0042865 A1 2/2013 Monsees
2013/0068239 A1 3/2013 Youn
2013/0140200 A1 6/2013 Scatterday
2013/0152922 A1 6/2013 Benassayag et al.
2013/0186416 A1 7/2013 Gao et al.
2013/0199528 A1 8/2013 Goodman et al.
2013/0220315 A1* 8/2013 Conley ..... A24F 47/008 128/202.21
2013/0228191 A1 9/2013 Newton
2013/0247924 A1 9/2013 Scatterday et al.
2013/0248385 A1 9/2013 Scatterday et al.
2013/0255702 A1 10/2013 Griffith, Jr. et al.
2013/0276802 A1 10/2013 Scatterday
2013/0298905 A1 11/2013 Levin et al.
2013/0312742 A1 11/2013 Monsees
2013/0319440 A1 12/2013 Capuano
2013/0333700 A1 12/2013 Buchberger
2013/0340775 A1 12/2013 Juster et al.
2014/0000638 A1* 1/2014 Sebastian ..... A24F 47/008 131/328
2014/0007891 A1 1/2014 Liu
2014/0014126 A1 1/2014 Peleg et al.
2014/0041655 A1 2/2014 Barron
2014/0053856 A1 2/2014 Liu
2014/0053858 A1 2/2014 Liu
2014/0060552 A1 3/2014 Cohen et al.
2014/0060556 A1 3/2014 Liu
2014/0096782 A1 4/2014 Ampolini et al.
2014/0109921 A1 4/2014 Chen
2014/0116455 A1 5/2014 Youn
2014/0123989 A1* 5/2014 LaMothe ..... A24F 47/008 131/328
2014/0123990 A1 5/2014 Timmermans
2014/0144429 A1 5/2014 Wensley et al.
2014/0150810 A1 6/2014 Hon
2014/0174459 A1 6/2014 Burstyn
2014/0190501 A1 7/2014 Liu
2014/0190503 A1 7/2014 Li et al.
2014/0196731 A1 7/2014 Scatterday
2014/0196735 A1 7/2014 Liu
2014/0216450 A1 8/2014 Liu
2014/0230835 A1 8/2014 Saliman
2014/0261474 A1 9/2014 Gonda
2014/0270727 A1 9/2014 Ampolini et al.
2014/0301721 A1 10/2014 Ruscio et al.
2014/0305450 A1 10/2014 Xiang
2014/0345631 A1 11/2014 Bowen et al.
2014/0345635 A1 11/2014 Rabinowitz et al.
2014/0355969 A1 12/2014 Stern
2014/0378790 A1 12/2014 Cohen
2015/0020823 A1 1/2015 Lipowicz et al.
2015/0020825 A1 1/2015 Galloway et al.
2015/0020831 A1 1/2015 Weigensberg et al.
2015/0027468 A1 1/2015 Li et al.
2015/0027472 A1 1/2015 Amir
2015/0034103 A1 2/2015 Hon
2015/0034104 A1 2/2015 Zhou
2015/0038567 A1 2/2015 Herkenroth et al.
2015/0040929 A1 2/2015 Hon
2015/0101625 A1 4/2015 Newton et al.
2015/0122252 A1 5/2015 Frija
2015/0122274 A1 5/2015 Cohen et al.
2015/0128965 A1 5/2015 Lord
2015/0128966 A1 5/2015 Lord
2015/0128967 A1 5/2015 Robinson et al.
2015/0128976 A1 5/2015 Verleur et al.
2015/0136153 A1 5/2015 Lord
2015/0136158 A1 5/2015 Stevens et al.
2015/0142387 A1 5/2015 Alarcon et al.
2015/0150308 A1 6/2015 Monsees et al.
2015/0157054 A1 6/2015 Liu
2015/0157056 A1 6/2015 Bowen et al.
2015/0164141 A1 6/2015 Newton
2015/0164144 A1 6/2015 Liu
2015/0164147 A1 6/2015 Verleur et al.
2015/0181928 A1 7/2015 Liu
2015/0189695 A1 7/2015 Xiang
2015/0196059 A1 7/2015 Liu
2015/0196060 A1 7/2015 Wensley et al.
2015/0208729 A1 7/2015 Monsees et al.
2015/0208731 A1 7/2015 Malamud et al.
2015/0216237 A1 8/2015 Wensley et al.
2015/0223521 A1 8/2015 Menting et al.
2015/0224268 A1 8/2015 Henry et al.
2015/0237917 A1 8/2015 Lord
2015/0237918 A1 8/2015 Liu
2015/0245654 A1 9/2015 Memari et al.
2015/0245660 A1 9/2015 Lord
2015/0257445 A1 9/2015 Henry, Jr. et al.
2015/0258289 A1 9/2015 Henry, Jr. et al.
2015/0272220 A1 10/2015 Spinka et al.
2015/0282525 A1 10/2015 Plojoux et al.
2015/0282527 A1 10/2015 Henry, Jr.
2015/0305409 A1 10/2015 Verleur et al.
2015/0313275 A1 11/2015 Anderson
2015/0313285 A1 11/2015 Waller et al.
2015/0320114 A1 11/2015 Wu
2015/0351456 A1 12/2015 Johnson et al.
2016/0021931 A1 1/2016 Hawes et al.
2016/0021933 A1 1/2016 Thorens et al.
2016/0044967 A1 2/2016 Bowen et al.
2016/0044968 A1 2/2016 Bowen et al.
2016/0058071 A1 3/2016 Hearn
2016/0058072 A1 3/2016 Liu
2016/0081395 A1 3/2016 Thorens et al.
2016/0106154 A1 4/2016 Lord
2016/0106155 A1 4/2016 Reevell
2016/0120218 A1 5/2016 Schennum et al.
2016/0135503 A1 5/2016 Liu

(56) References Cited

U.S. PATENT DOCUMENTS

| | | | |
|---|---|---|---|
| 2016/0143359 | A1 | 5/2016 | Xiang |
| 2016/0143365 | A1 | 5/2016 | Liu |
| 2016/0174611 | A1 | 6/2016 | Monsees et al. |
| 2016/0242466 | A1 | 8/2016 | Lord et al. |
| 2016/0249680 | A1 | 9/2016 | Liu |
| 2016/0295924 | A1 | 10/2016 | Liu |
| 2016/0302483 | A1 | 10/2016 | Liu |
| 2016/0309784 | A1 | 10/2016 | Silvestrini et al. |
| 2016/0324215 | A1 | 11/2016 | Mironov et al. |
| 2016/0331033 | A1 | 11/2016 | Hopps et al. |
| 2016/0331038 | A1 | 11/2016 | Farine et al. |
| 2016/0331040 | A1 | 11/2016 | Nakano et al. |
| 2016/0338410 | A1 | 11/2016 | Batista et al. |
| 2016/0338411 | A1 | 11/2016 | Liu |
| 2016/0345627 | A1 | 12/2016 | Liu |
| 2016/0345630 | A1 | 12/2016 | Mironov et al. |
| 2016/0368670 | A1 | 12/2016 | Beardsall |
| 2016/0371464 | A1 | 12/2016 | Bricker |
| 2016/0374390 | A1 | 12/2016 | Liu |
| 2016/0374398 | A1 | 12/2016 | Amir |

FOREIGN PATENT DOCUMENTS

| | | | |
|---|---|---|---|
| CN | 1122213 | A | 5/1996 |
| CN | 1333657 | A | 1/2002 |
| CN | 101869356 | A | 10/2010 |
| CN | 102754924 | A | 10/2012 |
| CN | 202873796 | U | 4/2013 |
| DE | 4200639 | | 7/1992 |
| DE | 19854005 | A1 | 5/2000 |
| DE | 19854012 | A1 | 5/2000 |
| EP | 0311581 | A1 | 4/1989 |
| EP | 0430559 | A2 | 6/1991 |
| EP | 0503767 | A1 | 9/1992 |
| EP | 0532194 | A1 | 3/1993 |
| EP | 0535695 | | 4/1993 |
| EP | 0283672 | B1 | 9/1993 |
| EP | 1458388 | A | 9/2004 |
| EP | 2325093 | B1 | 6/2012 |
| EP | 2609821 | A1 | 7/2013 |
| EP | 2152313 | B1 | 9/2014 |
| EP | 2772148 | | 9/2014 |
| EP | 3024343 | A2 | 1/2015 |
| EP | 2856893 | A1 | 4/2015 |
| EP | 2908675 | A1 | 8/2015 |
| EP | 2319934 | B1 | 9/2015 |
| EP | 2915443 | A1 | 9/2015 |
| EP | 3062646 | A1 | 9/2016 |
| EP | 3065581 | A2 | 9/2016 |
| EP | 3068244 | A1 | 9/2016 |
| ES | 2118034 | A1 | 9/1998 |
| GB | 1025630 | A | 4/1966 |
| GB | 1065678 | | 4/1967 |
| IE | S2005-0051 | | 2/2005 |
| IE | S2005-0563 | | 8/2005 |
| IE | S2005-0615 | | 9/2005 |
| JP | 61-108364 | | 5/1986 |
| JP | 62-278975 | | 12/1987 |
| JP | 64-37276 | A | 2/1989 |
| JP | 2-124082 | | 5/1990 |
| JP | 02-145179 | A | 6/1990 |
| JP | 03-049671 | | 4/1991 |
| JP | 03-180166 | | 8/1991 |
| JP | 05-115272 | | 5/1993 |
| JP | 1993-115272 | | 5/1993 |
| JP | 09-075058 | | 3/1997 |
| JP | 10-501999 | A | 2/1998 |
| JP | 11-178563 | | 6/1999 |
| JP | 2000-203639 | | 7/2000 |
| JP | 2000-236865 | | 9/2000 |
| JP | 2001-165437 | A | 6/2001 |
| JP | 1991-232481 | | 10/2001 |
| JP | 2002-529111 | | 9/2002 |
| JP | 2005-034021 | A | 2/2005 |
| JP | 2005-506080 | | 3/2005 |
| JP | 2006-504430 | A | 2/2006 |
| KR | 0193885 | B1 | 6/1999 |
| WO | WO-1995-01137 | A1 | 1/1995 |
| WO | WO97/12639 | A1 | 4/1997 |
| WO | WO-2000-28842 | A1 | 5/2000 |
| WO | WO-2001-82725 | A1 | 11/2001 |
| WO | WO 2003-056948 | A1 | 7/2003 |
| WO | WO-2003-070031 | A1 | 8/2003 |
| WO | WO03/082031 | A1 | 10/2003 |
| WO | WO03/094900 | A1 | 11/2003 |
| WO | WO 03/103387 | A2 | 12/2003 |
| WO | WO-2004-064548 | A1 | 8/2004 |
| WO | WO2004/080216 | A1 | 9/2004 |
| WO | WO-2005-020726 | A1 | 3/2005 |
| WO | WO-2006-015070 | | 2/2006 |
| WO | WO-2006-082571 | A1 | 8/2006 |
| WO | WO-2007-012007 | A2 | 1/2007 |
| WO | WO-2007-012007 | A3 | 1/2007 |
| WO | WO-2007-026131 | | 3/2007 |
| WO | WO-2007-039794 | A2 | 4/2007 |
| WO | WO-2007-042941 | | 4/2007 |
| WO | WO2007/078273 | A1 | 7/2007 |
| WO | WO2008/077271 | A1 | 7/2008 |
| WO | WO-2009-079641 | A2 | 6/2009 |
| WO | WO-2009-079641 | A3 | 6/2009 |
| WO | WO2010/023561 | A1 | 3/2010 |
| WO | WO2011/033396 | A2 | 3/2011 |
| WO | WO2011/117580 | A2 | 9/2011 |
| WO | WO2012/021972 | A1 | 2/2012 |
| WO | WO2012/027350 | A2 | 3/2012 |
| WO | WO2012/085207 | A1 | 6/2012 |
| WO | WO2012/120487 | A2 | 9/2012 |
| WO | WO-2013-025921 | A1 | 2/2013 |
| WO | WO2013/04453 | A1 | 4/2013 |
| WO | WO2013/050934 | A1 | 4/2013 |
| WO | WO2013/083635 | A1 | 6/2013 |
| WO | WO2013/089551 | A1 | 6/2013 |
| WO | WO2013/098398 | A2 | 7/2013 |
| WO | WO2013/142678 | A1 | 9/2013 |
| WO | WO2014/040915 | A1 | 3/2014 |
| WO | WO2014/093127 | A2 | 6/2014 |
| WO | WO2014/101734 | A1 | 7/2014 |
| WO | WO2014/118286 | A2 | 8/2014 |
| WO | WO2014/139611 | A1 | 9/2014 |
| WO | WO2014/140087 | A1 | 9/2014 |
| WO | WO2014/150704 | A2 | 9/2014 |
| WO | WO2014/159982 | A1 | 10/2014 |
| WO | WO2014/187763 | A1 | 11/2014 |
| WO | WO2014/187770 | A2 | 11/2014 |
| WO | WO-2014-201432 | | 12/2014 |
| WO | WO2014/205263 | A1 | 12/2014 |
| WO | WO2015/006652 | A1 | 1/2015 |
| WO | WO2015/009862 | A2 | 1/2015 |
| WO | WO2015/028815 | A1 | 3/2015 |
| WO | WO2015/040180 | A2 | 3/2015 |
| WO | WO2015/058387 | A1 | 4/2015 |
| WO | WO2015/063126 | A1 | 5/2015 |
| WO | WO2015/082652 | A1 | 6/2015 |
| WO | WO2015/084544 | A1 | 6/2015 |
| WO | WO2015/089711 | A1 | 6/2015 |
| WO | WO2015/101651 | A1 | 7/2015 |
| WO | WO2015/109616 | A1 | 7/2015 |
| WO | WO2015/124878 | A1 | 8/2015 |
| WO | WO2015/148547 | A1 | 10/2015 |
| WO | WO2015/149647 | A1 | 10/2015 |
| WO | WO2015/169127 | A1 | 11/2015 |
| WO | WO2015/175979 | A1 | 11/2015 |
| WO | WO2015/179641 | A1 | 11/2015 |
| WO | WO2016/168828 | A1 | 11/2015 |

OTHER PUBLICATIONS

Monsees et al.; U.S. Appl. No. 15/257,748 entitled "Cartridge for use with a vaporizer device," filed Sep. 6, 2016.

Monsees et al.; U.S. Appl. No. 15/257,760 entitled "Vaporizer apparatus," filed Sep. 6, 2016.

Monsees et al.; U.S. Appl. No. 15/257,768 entitled "Vaporizer apparatus," filed Sep. 6, 2016.

(56) References Cited

OTHER PUBLICATIONS

ECF; Any interest in determining nicotine—by DVAP; (https://www.e-cigarette-forum.com/forum/threads/any-interest-in-determining-nicotine-by-dvap.35922/); blog posts dated: 2009; 8 pgs.; print/retrieval date: Jul. 31, 2014.
YouTube; Firefly Vaporizer Review w/ Usage Tips by The Vape Critic; retrieved from the Internet (http://www.youtube.com/watch?v=1J38N0AV7w1); 1 pg.; published Dec. 10, 2013; download/print date: Feb. 18, 2015.
Monsees, J.; U.S. Appl. No. 12/115,400 entitled "Method and System for Vaporization of a Substance", filed May 5, 2008.
Bowen et al.; U.S. Appl. No. 14/960,259 entitled "Calibrated Dose Control", filed Dec. 4, 2015.
Bradley et al.; Electronic cigarette aerosol particle size distribution measurements; Inhal. Toxicol.; 24(14); pp. 976-984; Dec. 2012.
Bullen et al.; Effect of an electronic nicotine delivery device (e cigarette) on desire to smoke and withdrawal, user preferences and nicotine delivery: randomised cross-over trial; Tobacco Control; 19(2); pp. 98-103; Apr. 2010.
Burch et al.; Effect of pH on nicotine absorption and side effects produced by aerosolized nicotine; Journal of Aerosol Medicine; Deposition, Clearance, and Effects in the Lung; 6(1); pp. 45-52; 1993.
Capponnetto et al.; Successful smoking cessation with cigarettes in smokers with a documented history of recurring relapses: a case series; Journal of Medical Case Reports; 5(1); 6 pages; (year of pub. sufficiently earlier than effective US filed and any foreign priority date); 2011.
Farsalinos et al.; Electronic cigarettes do not damage the heart; European Society of Cardiology; 4 pages; retrieved from the Internet (http://www.escardio.org/The-ESC/Press-Office/Press-releases/Electronic-cigarettes-do-not-damage-the-heart); Aug. 25, 2012.
Flouris et al.; Acute impact of active and passive electronic cigarette smoking on serum cotinine and lung function; Inhal. Toxicol.; 25(2); pp. 91-101; Feb. 2013.
Food & Drug Administration; Warning letter to The Compounding Pharmacy; retrieved Oct. 10, 2014 from http://www.fda.gov/ICECI/EnfocementActions/WarningLetters/2002/ucm144843.htm; 3 pgs.; Apr. 9, 2002.
Goniewicz et al.; Nicotine levels in electronic cigarettes; Nicotine Tobacco Research; 15(1); pp. 158-166; Jan. 2013.
Harvest Vapor; American Blend Tobacco (product info.); retrieved from the Internet (http://harvestvapor.com/); 2 pgs.; print/retrieval date: Oct. 10, 2014.
Hurt et al.; Treating tobacco dependence in a medical setting; CA: A Cancer Journal for Clinicians; 59(5); pp. 314-326; Sep. 2009.
Inchem; Benzoic Acid; JECFA Evaluation Summary; retrieved Oct. 10, 2014 from http://www.inchem.org/documents/jecfa/feceval/jec_184.htm; 2 pgs..; May 28, 2005.
Inchem; Levulinic Acid; JECFA Evaluation Summary; retrieved Oct. 10, 2014 from http://www.inchem.org/documents/jecfa/feceval/jec_1266.htm; 1 pg.; Mar. 10, 2003.
Inchem; Pyruvic Acid; JECFA Evaluation Summary; retrieved Oct. 10, 2014 from http://www.inchem.org/documents/jecfa/feceval/jec_2072.htm; 1 pg.; Jan. 29, 2003.
Inchem; Sorbic Acid; JECFA Evaluation Summary; retrieved Oct. 10, 2014 from http://www.inchem.org/documents/jecfa/feceval/jec_2181.htm; 1 pg.; May 29, 2005.
Perfetti; Structural study of nicotine salts; Beitrage zur Tabakforschung International; Contributions to Tobacco Research; 12(2); pp. 43-54; Jun. 1983.
Seeman et al.; The form of nicotine in tobacco. Thermal transfer of nicotine and nicotine acid salts to nicotine in the gas phase; J Aric Food Chem.; 47(12); pp. 5133-5145; Dec. 1999.
Vansickel et al.; A clinical laboratory model for evaluating the acute effects of electronic cigarettes: Nicotine delivery profile and cardiovascular and subjective effects; Cancer Epidemiology Biomarkers Prevention; 19(8); pp. 1945-1953; (online) Jul. 20, 2010.
Vansickel et al.; Electronic cigarettes: effective nicotine delivery after acute administration; Nicotine & Tobacco Research; 15(1); pp. 267-270; Jan. 2013.
Zhang et al.; In vitro particle size distributions in electronic and conventional cigarette aerosols suggest comparable deposition patterns; Nicotine Tobacco Research; 15(2); pp. 501-508; Feb. 2013.
Monsees et al.; U.S. Appl. No. 15/261,823 entitled "Low temperature electronic vaporization device and methods," filed Sep. 9, 2016.
"Lighter." Merriam-Webster Online Dictionary. 2009. Merriam-Webster Online. Jun. 8, 2009 [http://www.merriam-webster.com/dictionary/lighter].
Baker et al., "The pyrolysis of tobacco ingredients," J. Anal. Appl. Pyrolysis, vol. 71, pp. 223-311 (2004).
Bombick, et al. Chemical and biological studies of a new cigarette that primarily heats tobacco. Part 2. In vitro toxicology of mainstream smoke condensate. Food and Chemical Toxicology. 1997; 36:183-190.
Bombick, et al. Chemical and biological studies of a new cigarette that primarily heats tobacco. Part 3. In vitro toxicity of whole smoke. Food and Chemical Toxicology. 1998; 36:191-197.
Borgerding, et al. Chemical and biological studies of a new cigarette that primarily heats tobacco. Part 1. Chemical composition of mainstream smoke. Food and Chemical Toxicology. 1997; 36:169-182.
Davis & Nielsen, "Marketing, Processing and Storage: Green Leaf Threshing and Redrying Tobacco," Tobacco Production, Chemistry and Technology, (1999) Section 10B, pp. 330-333, Bill Ward, Expert Leaf Tobacco Company, Wilson, North Carolina, USA.
European Patent Application 06787864.5 Exam Report dated Nov. 12, 2013.
European Patent Application 06787864.5 Extended European Search Report dated Mar. 22, 2013.
European Patent Application 08860921.9 Extended European Search Report dated Oct. 10, 2013.
European Patent Application 14153340.6. European search report and search opinion dated Oct. 8, 2014.
European search report dated May 9, 2014 for EP Application No. 14153326.5.
European search report dated May 9, 2014 for EP Application No. 14153324.0.
European search report dated May 9, 2014 for EP Application No. 14153323.2.
European search report dated May 9, 2014 for EP Application No. 14153321.6.
European search report dated May 26, 2014 for EP Application No. 14153327.3.
European search report dated Jun. 13, 2014 for EP Application No. 13189967.6.
European search report dated Jun. 20, 2014 for EP Application No. 14153325.7.
Ingebrethsen et al., "Electronic Cigarette aerosol particle size distribution measurements", Inhalation Toxicology, 2012; 24 (14): 976-984.
Kuo et al. Applications of Turbulent and Multiphase Combustion, Appendix D: Particle Size-U.S. Sieve Size and Tyler Screen Mesh Equivalents, 2012, p. 541-543.
McCann et al., "Detection of carcinogens as mutagens in the *Salmonella*/microsome test: Assay of 300 chemicals: discussion." Proct. Nat. Acad. Sci, USA, Mar. 1976, vol. 73 (3), 950-954.
Nicoli et al., Mammalian tumor xenografts induce neovascularization in Zebrafish embryos. Cancer Research, 67:2927-2931 (2007).
U.S. Appl. No. 11/485,168 Office action dated Feb. 4, 2010.
U.S. Appl. No. 11/485,168 Office action dated Mar. 27, 2014.
U.S. Appl. No. 11/485,168 Office action dated Jun. 23, 2009.
U.S. Appl. No. 11/485,168 Office action dated Jul. 9, 2014.
U.S. Appl. No. 11/485,168 Office action dated Aug. 3, 2010.
U.S. Appl. No. 11/485,168 Office action dated Sep. 5, 2013.
U.S. Appl. No. 11/485,168 Office action dated Nov. 3, 2009.
U.S. Appl. No. 11/485,168 Office action dated Dec. 21, 2012.
U.S. Appl. No. 12/336,439 Final Action dated Nov. 25, 2013.
U.S. Appl. No. 12/336,439 Final Action dated Feb. 1, 2012.
U.S. Appl. No. 12/336,439 Office Action dated Aug. 17, 2011.
U.S. Appl. No. 12/336,439 Office Action dated Feb. 22, 2013.

(56) References Cited

OTHER PUBLICATIONS

U.S. Appl. No. 12/336,439 Office Action dated Feb. 28, 2014.
U.S. Appl. No. 12/482,379 Final Office Action dated Sep. 5, 2012.
U.S. Appl. No. 12/482,379 Non Final Office Action dated Dec. 17, 2013.
U.S. Appl. No. 12/482,379 Office Action dated Dec. 22, 2011.
U.S. Appl. No. 13/587,416 Office Action dated Oct. 31, 2014.
U.S. Appl. No. 29/446,987 Office Action dated Nov. 13, 2014.
PCT/US2012/051165 International Preliminary Report on Patentability dated Feb. 18, 2014.
PCT/US2012/051165 International Search Report and Written Opinion dated Oct. 25, 2012.
PCT/US2006/28039 IPER and Written Opinion dated Jul. 15, 2008.
PCT/US2006/28039 ISR dated Sep. 6, 2007.
PCT/US2006/28039 Corrected Written Opinion dated Dec. 20, 2007.
PCT/US2008/87488 International Search Report dated Jul. 13, 2009.
PCT/US2008/87488 Written Opinion dated Jul. 13, 2009.
PCT/US2008/87488 IPRP dated Jun. 22, 2010.
PCT/US2014/042425 International Search Report and Written Opinion dated Nov. 3, 2014.
Torikai et al., "Effects of temperature, atmosphere and pH on the generation of smoke compounds during tobacco pyrolysis," Food and Chemical Toxicology 42 (2004) 1409-1417.
Wells. "Glycerin as a Constituent of Cosmetics and Toilet Preparations." Journal of the Society of Cosmetic Chemists,1958; 9(1): 19-25.
European Extended European Search Report dated Mar. 4, 2015 for EP Patent Application No. 12824116.3.
European Communication dated Jan. 28, 2015 for EP Patent Application No. 14153321.6.
European Communication dated Jan. 29, 2015 for EP Application No. 14153323.2.
European Communication dated Jan. 29, 2015 for EP Application No. 14153326.5.
European Communication dated Jan. 30, 2015 for EP Application No. 14153327.3.
Grotenhermen et al.; Developing science-based per se limits for driving under the influence of cannabis (DUIC): findings and recommendations by an expert panel; retrieved Feb. 9, 2017 from (http://www.canorml.org/healthfacts/DUICreport.2005.pdf); 49 pages; Sep. 2005.
Monsees et al.; U.S. Appl. No. 15/368,539 entitled "Low temperature electronic vaporization device and methods," filed Dec. 2, 2016.
Bowen et al.; U.S. Appl. No. 15/309,554 entitled "Systems and methods for aerosolizing a smokeable material," filed Nov. 8, 2016.
Monsees et al.; U.S. Appl. No. 15/379,898 entitled "Vaporization device systems and methods," filed Dec. 15, 2016.
Hatton et al.; U.S. Appl. No. 15/396,584 entitled "Leak-resistant vaporizer cartridges for use with cannabinoids," filed Dec. 31, 2016.
E-Cigarette Forum; pg-gv-peg (discussion/posting); retrieved from the internet: https://e-cigarette-forum.com/forum/threads/pg-vg-peg.177551; 7 pgs.; Apr. 8, 2011.
Monsees et al.; U.S. Appl. No. 15/165,954 entitled "Devices for vaporization of a substance," filed May 26, 2016.
Monsees et al.; U.S. Appl. No. 15/166,001 entitled "Electronic vaporization device," filed May 26, 2016.
Monsees et al.; U.S. Appl. No. 15/165,972 entitled "Portable devices for generating an inhalable vapor," filed May 26, 2016.
Bowen et al.; U.S. Appl. No. 15/101,303 entitled "Nicotine liquid formulations for aerosol devices and methods thereof," filed Jun. 2, 2016.

* cited by examiner

MULTIPLE HEATING ELEMENTS WITH SEPARATE VAPORIZABLE MATERIALS IN AN ELECTRIC VAPORIZATION DEVICE

CROSS-REFERENCE TO RELATED APPLICATIONS

This application claims the benefit of U.S. Application Ser. No. 61/835,458, filed Jun. 14, 2013, which is hereby incorporated by reference in its entirety.

SUMMARY OF THE INVENTION

Devices and methods for electronic vaporization having a first heating element, a first compartment for containment of a first vaporizable material, and a second compartment for containment of a second vaporizable material wherein the device and methods generate an aerosol for inhalation by a subject by heating the first vaporizable material or the second vaporizable material.

In some aspects provided herein is a device for generating an inhalable aerosol comprising: a detachable cartridge comprising, a first compartment for containment of a first vaporizable material, a first heating element, and a second compartment for containment of a second vaporizable material, wherein the first vaporizable material in the first compartment is the same or different as the second vaporizable material in the second compartment; and a body having a battery and circuitry for controlling the device, wherein the detachable cartridge and body are coupled by a first connection mechanism and wherein the first heating element is configured to vaporize the first vaporizable material. In some embodiments the device further comprises a second heating element, wherein the second heating element is configured to vaporize the second vaporizable material. In some embodiments, the device is configured so that the first heating element is configured to vaporize the second vaporizable material. In some embodiments, the device is configured so that the first heating element comprises a resistive heater circuit or the second heating element comprises a resistive heater circuit.

In some embodiments, the device is configured so that the first heating element is configured to heat to a first target temperature, and the second heating element is configured to heat to a second target temperature. Examples of first and second target temperatures include but are not limited to from about 100° to about 300° C., from about 125° to about 255° C., from about 150° to about 230° C., from about 170° to about 210° C. In some embodiments the first target temperature is different from the second target temperature.

In some embodiments the device is be configured so that the first heating element comprises a first wire having a first end and a second end, the first wire in contact with the first wicking material, wherein the first wicking material is in fluid communication with the first vaporizable material. In some embodiments the first heating element is in the first compartment and wherein the first end and the second end of the first wire exit the first compartment and couple electrically to the body. In some embodiments of at least one aspect the second heating element comprises a second wire having a third end and a fourth end, the second wire in contact with the second wicking material, wherein the second wicking material is in fluid communication with the second vaporizable material. In some embodiments the second heating element is in the second compartment and wherein the third end and the fourth end of the second wire exit the second compartment and couple electrically to the body.

In some embodiments the device is be configured so that the first wicking material and the second wicking material have the same material properties or different material properties, same or different wicking properties, have the same wicking rate or different wicking rate due to the wicking properties of the first wicking material and the second wicking material, and the same wicking rate or different wicking rate due to configurations of the circuitry.

In some embodiments the device is be configured so that the first compartment and the second compartment are in series within the detachable cartridge relative to an airflow path, the first compartment and the second compartment are in parallel within the detachable cartridge relative to an airflow path, and the first compartment and the second compartment share a common axis within the detachable cartridge. In some embodiments the common axis is aligned with a central axis of an airflow path. In some embodiments the second compartment are stacked, concentric, aligned around a central axis, or in a parallel alignment within the detachable cartridge.

In some embodiments the first compartment and the second compartment are removable from the cartridge. In some embodiments the first compartment and the second compartment are replaceable with a third compartment or a fourth compartment in the cartridge.

In some embodiments the device is configured so that the connection mechanism comprises: a threaded connection; a tapered connection; a magnetic connection; a spring-loaded connection; a spring detent connection; a snap-fit connection; a compression connection; or any combination thereof.

In some embodiments the device is configured so that the body further comprises at least one push button for operator control of the circuitry.

In some embodiments the device is configured so that the first compartment comprises a first airflow path, and the second compartment has a second airflow path that is in communication with the first airflow path. In some embodiments the first compartment comprises a first airflow path, and the second compartment has a second airflow path, wherein first vapor from the first airflow path is introduced to second vapor from the second airflow path prior to exiting the cartridge. In some embodiments the first compartment comprises a first chamber comprising the first airflow path, and the second compartment comprises a second chamber comprising the second airflow path, wherein introduction of the first vapor to the second vapor occurs in the second chamber. In some embodiments the cartridge comprises a third chamber and introduction of the first vapor to the second vapor occurs in the chamber. In some embodiments the cartridge further comprises a mouthpiece.

In some embodiments the device is configured so that the vaporizable material comprises a liquid, a gel, a viscous material, a temperature sensitive mesophase material, or a combination thereof. In some embodiments the first vaporizable material or the second vaporizable material comprise: nicotine; flavorants; humectants; water; or a combination thereof.

In some embodiments the device is configured so that the circuitry includes an accelerometer. In some embodiments the accelerometer functions comprise: determining if a user is actively using the device; providing a battery power level feedback of the device to the user; providing the user with a mechanism to change a mode of the device; providing an automatic activation mode when the device is picked up by the user; providing a selective pre-heat mode for the resistive heating elements; and providing an automatic sleep mode when the device is inactive for a period of time.

In some embodiments the device is configured so that the cartridge is available in 2-compartment modules, 3-compartment modules, or multi-compartment modules.

In some embodiments the device is configured so that the device comprises a first capacitive sensing zone and a second capacitive sensing zone, wherein the first zone is electrically isolated from the second zone, and wherein the first zone comprises a first capacitive sensor and the second zone comprises a second capacitive sensor. In some embodiments the first zone and second zone are configured so that when the first zone and second zone are contacted by a user, the device communicates information to the user, the information comprising, a battery charge level, a vaporizable material level, a pre-heat state, or a combination thereof. In some embodiments the first zone and second zone are configured so that when a user swipes a finger from the first zone to the second zone or from the second zone to the first zone, the device communicates information to the user, the information comprising, a battery charge level, a vaporizable material level, a pre-heat state, or a combination thereof. In some embodiments the first zone and second zone are configured so that when a user swipes a finger from the first zone to the second zone or from the second zone to the first zone, the device is activated.

In some aspects provided herein is a cartridge for use with a vaporization device comprising: a first vaporizable material, a first compartment that contains the first vaporizable material, a first heating element, a second vaporizable material, and a second compartment that contains the second vaporizable material, wherein the first vaporizable material in the first compartment is the same as or different from the second vaporizable material in the second compartment, wherein the cartridge comprises a first portion of a first connection mechanism for detachable connection to a body of the vaporization device, and wherein the first heating element is configured to vaporize the first vaporizable material. In some embodiments the cartridge is configured so that the second heating element is configured to vaporize the second vaporizable material. In some embodiments the cartridge is configured so that the first heating element is configured to vaporize the second vaporizable material. In some embodiments the cartridge is configured so that the first heating element comprises a resistive heater circuit. In some embodiments the cartridge is configured so that the second heating element comprises a resistive heater circuit. In some embodiments the cartridge is configured so that the first heating element is configured to heat to a first target temperature, and the second heating element is configured to heated to a second target temperature that is different from the first target temperature, wherein the first heating element material properties are different than the second heating element material properties.

In some embodiments the cartridge is configured so that the first target temperature is from about 100° to about 300° C., from about 125° to about 255° C., from about 150° to about 230° C., from about 170° to about 210° C. In some embodiments the cartridge is configured so that the second target temperature is from about 100° to about 300° C., from about 125° to about 255° C., from about 150° to about 230° C., from about 170° to about 210° C.

In some embodiments the cartridge is configured so that a first wicking material, wherein the first heating element comprises a first wire having a first end and a second end in contact with the first wicking material, wherein the first wicking material is in fluid communication with the first vaporizable material. In some embodiments the cartridge is configured so that the first heating element is in the first compartment and wherein the first end and the second end of the first wire exits the first compartment and couple electrically to the body.

In some embodiments the cartridge is configured so that the second heating element comprises a second wire having a third end and a fourth end in contact with the second wicking material, wherein the second wicking material is in fluid communication with the second vaporizable material. In some embodiments the cartridge is configured so that the second heating element is in the second compartment and wherein the third end and the fourth end of the second wire exits the second compartment and couple electrically to a battery of the device.

In some embodiments the cartridge is configured so that the first wicking material and the second wicking material have the same material properties or different material properties. In some embodiments the cartridge is configured so that the first wicking material and the second wicking material have the same wicking properties or different wicking properties. In some embodiments the first wicking material and the second wicking material have the same wicking rate or different wicking rate due to the wicking properties of the first wicking material and the second wicking material. In some embodiments the cartridge is configured so that the first wicking material and the second wicking material have the same wicking rate or different wicking rate due to differences between the first vaporizable material and the second vaporizable material.

In some embodiments the cartridge is configured so that the first compartment and the second compartment are in series within the cartridge relative to an airflow path. In some embodiments the cartridge is configured so that the first compartment and the second compartment are in parallel within the cartridge relative to an airflow path. In some embodiments the cartridge is configured so that the first compartment and the second compartment share a common axis within the detachable cartridge. In some embodiments the cartridge is configured so that the common axis is aligned with a central axis of an airflow path. In some embodiments the cartridge is configured so that the first compartment and the second compartment are stacked, concentric, aligned around a central axis, or in a parallel alignment within the detachable cartridge.

The cartridge of claim 34, wherein the first compartment and the second compartment are removable from the cartridge. In some embodiments the first compartment and the second compartment are replaceable with a third compartment or a fourth compartment in the cartridge.

In some embodiments the cartridge is configured so that the first connection mechanism comprises: a threaded connection; a tapered connection; a magnetic connection; a spring-loaded connection; a spring detent connection; a snap-fit connection; a compression connection; or any combination thereof.

In some embodiments the cartridge is configured so that the cartridge further comprises a mouthpiece.

In some embodiments the cartridge is configured so that the first compartment comprises a first airflow path, and the second compartment has a second airflow path that is in communication with the first airflow path. In some embodiments the first compartment comprises a first airflow path, and the second compartment has a second airflow path, wherein first vapor from the first airflow path is introduced to second vapor from the second airflow path prior to exiting the cartridge. In some embodiments the first compartment comprises a first chamber comprising the first airflow path, and the second compartment comprises a second chamber comprising the second airflow path, wherein introduction of the first vapor to the second vapor occurs in the second chamber. In some embodiments the cartridge comprises a third chamber and introduction of the first vapor to the second vapor occurs in the chamber.

In some embodiments of any aspect the device, cartridge or method comprises a pre-heat temperature for the first heating element or the second hearing element is from about 100° C. to about 130° C.

In some embodiments the cartridge is configured so that the vaporizable material comprises a liquid, a gel, a viscous material, a temperature sensitive mesophase material, or a combination thereof. In some embodiments the first vaporizable material or the second vaporizable material comprise: nicotine; flavorants; humectants; water; or a combination thereof. In some embodiments the cartridge is available in 2-compartment modules, 3-compartment modules, or multi-compartment modules.

In some aspects provided herein is a method of generating an aerosol comprising: providing an aerosol generating device comprising: a cartridge comprising, a first vaporizable material, a first compartment that contains the first vaporizable material, a first heating element, a second vaporizable material, and a second compartment that contains the second vaporizable material, wherein the first vaporizable material in the first compartment is the same or different as the second vaporizable material in the second compartment; and a body having a battery and circuitry for controlling the device, wherein the detachable cartridge and body are coupled by a first connection mechanism and wherein the first heating element is configured to vaporize the first vaporizable material, wherein the device is configured to generate a first aerosol in a first airflow path from the first vaporizable material, generate a second aerosol from the second vaporizable material in the first airflow path or a second airflow path, and deliver the first aerosol and the second aerosol to a user, or generate a first vapor in a first airflow path from the first vaporizable material, generate a second vapor from the second vaporizable material in the first airflow path or a second airflow path, and deliver to a user a third aerosol comprising condensate of the first vapor and the second vapor or a fourth aerosol generated from a third vapor, the third vapor formed when the first vapor is introduced to the second vapor or condensate thereof, or a fifth aerosol generated when the first aerosol is introduced to the second vapor or condensate thereof.

In some embodiments the first heating element is configured to heat to a first target temperature, and the second heating element is configured to heat to a second target temperature. Examples of first and second target temperatures include but are not limited to from about 100° to about 300° C., from about 125° to about 255° C., from about 150° to about 230° C., from about 170° to about 210° C. In some embodiments the first target temperature is different from the second target temperature.

In some embodiments the device is be configured so that the first heating element comprises a first wire having a first end and a second end, the first wire in contact with the first wicking material, wherein the first wicking material is in fluid communication with the first vaporizable material. In some embodiments the first heating element is in the first compartment and wherein the first end and the second end of the first wire exit the first compartment and couple electrically to the body. In some embodiments of at least one aspect the second heating element comprises a second wire having a third end and a fourth end, the second wire in contact with the second wicking material, wherein the second wicking material is in fluid communication with the second vaporizable material. In some embodiments the second heating element is in the second compartment and wherein the third end and the fourth end of the second wire exit the second compartment and couple electrically to the body.

In some embodiments the device is be configured so that the first wicking material and the second wicking material have the same material properties or different material properties, same or different wicking properties, have the same wicking rate or different wicking rate due to the wicking properties of the first wicking material and the second wicking material, and the same wicking rate or different wicking rate due to configurations of the circuitry.

In some embodiments the device is be configured so that the first compartment and the second compartment are in series within the detachable cartridge relative to an airflow path, the first compartment and the second compartment are in parallel within the detachable cartridge relative to an airflow path, and the first compartment and the second compartment share a common axis within the detachable cartridge. In some embodiments the common axis is aligned with a central axis of an airflow path. In some embodiments the second compartment are stacked, concentric, aligned around a central axis, or in a parallel alignment within the detachable cartridge.

In some embodiments the first compartment and the second compartment are removable from the cartridge. In some embodiments the first compartment and the second compartment are replaceable with a third compartment or a fourth compartment in the cartridge.

In some embodiments the connection mechanism comprises: a threaded connection; a tapered connection; a magnetic connection; a spring-loaded connection; a spring detent connection; a snap-fit connection; a compression connection; or any combination thereof.

In some embodiments the body further comprises at least one push button for operator control of the circuitry.

In some embodiments the first compartment comprises a first airflow path, and the second compartment has a second airflow path that is in communication with the first airflow path. In some embodiments the first compartment comprises a first airflow path, and the second compartment has a second airflow path, wherein first vapor from the first airflow path is introduced to second vapor from the second airflow path prior to exiting the cartridge. In some embodiments the first compartment comprises a first chamber comprising the first airflow path, and the second compartment comprises a second chamber comprising the second airflow path, wherein introduction of the first vapor to the second vapor occurs in the second chamber. In some embodiments the cartridge comprises a third chamber and introduction of the first vapor to the second vapor occurs in the chamber. In some embodiments the cartridge further comprises a mouthpiece.

In some embodiments the vaporizable material comprises a liquid, a gel, a viscous material, a temperature sensitive mesophase material, or a combination thereof. In some embodiments the first vaporizable material or the second vaporizable material comprise: nicotine; flavorants; humectants; water; or a combination thereof.

In some embodiments the first compartment comprises the first airflow path, and the second compartment comprises the second airflow path that is in communication with the first airflow path.

In some embodiments the first compartment comprises the first airflow path, and the second compartment comprises the second airflow path, wherein the device is configured to introduce the first vapor or condensate thereof from the first airflow path to second vapor or condensate thereof from the second airflow path prior to exiting the cartridge.

In some embodiments the first compartment comprises a first chamber comprising the first airflow path, and the second compartment comprises a second chamber comprising the second airflow path, wherein introduction of the first vapor of condensate thereof to the second vapor or condensate thereof occurs in the second chamber.

In some embodiments the cartridge comprises a third chamber and introduction of the first vapor or condensate thereof to the second vapor or condensate thereof occurs in the third chamber.

In some embodiments the cartridge further comprises a mouthpiece.

In some embodiments the first vaporizable material comprises water.

In some embodiments the second vaporizable material comprises water.

In some embodiments the device is configured to heat the first vaporizable material to a lower temperature than a second temperature to which the second vaporizable material is heated.

In some embodiments the device is configured to heat the second vaporizable material to a lower temperature than a second temperature to which the first vaporizable material is heated.

In some embodiments of at least one aspect described above the device is configured so the device functions as a water-cooled smoking apparatus.

INCORPORATION BY REFERENCE

All publications, patents, and patent applications mentioned in this specification are herein incorporated by reference to the same extent as if each individual publication, patent, or patent application was specifically and individually indicated to be incorporated by reference in its entirety.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
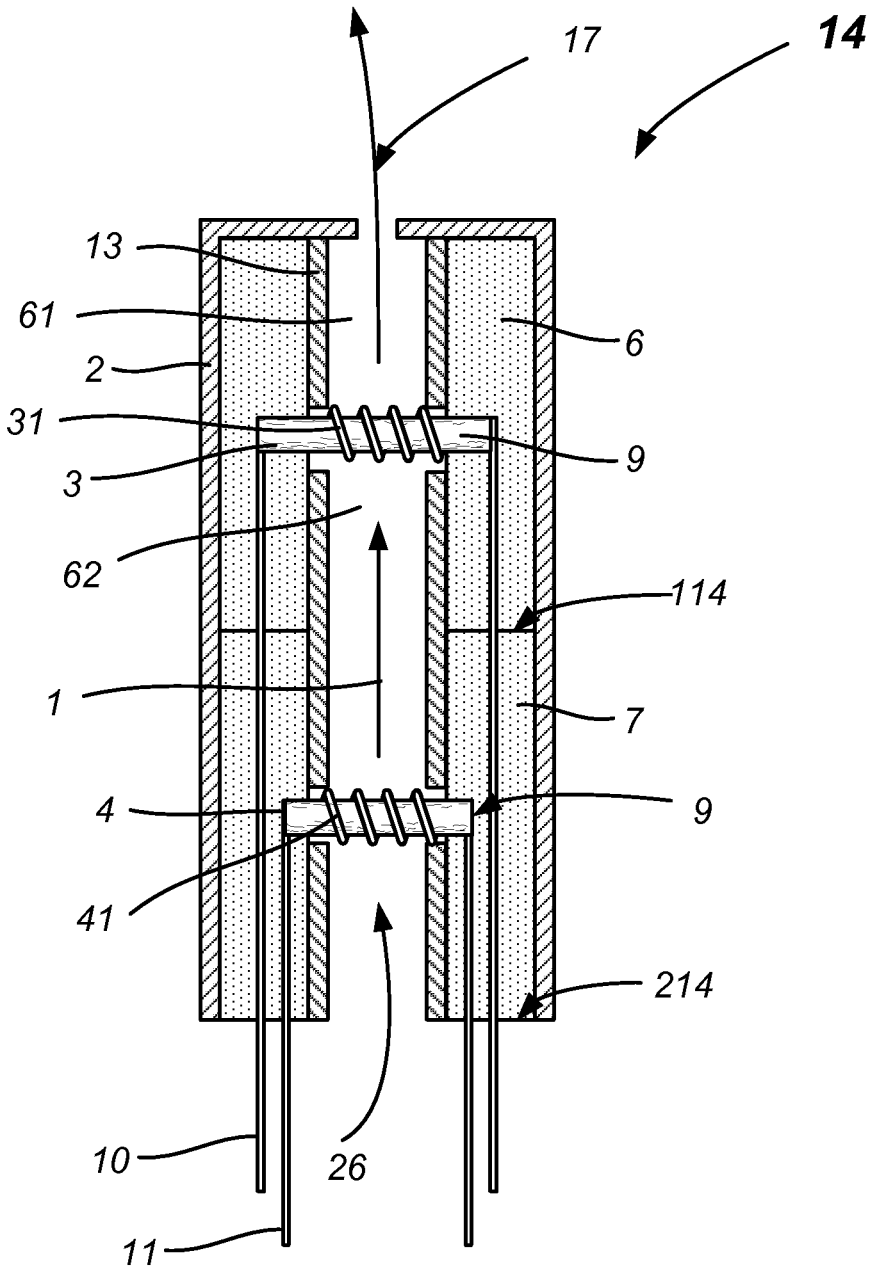
FIG. 1 illustrates a sectional view of a detachable cartridge having a first heating element, a second heating element, a first compartment for containment of vaporizable material, and a second compartment for containment of vaporizable material.

The invention described herein has a wide range of applications for inhalation of an active substance as will be appreciated by persons of skill in the art upon reviewing the disclosure. For example, the devices, and cartridges (i.e. pods), such as those disclosed in U.S. application Ser. No. 11/485,168, systems, kits and methods could be used, for example, to inhale a tobacco product through the mouth or nose. The devices, systems, kits and methods could be used, for example, to inhale any substance, such as a botanical, pharmaceutical, nutraceutical, or any other substance providing a benefit or sensation to an end user.

Further, active substances such as those disclosed in U.S. application Ser. No. 14/271,071, similar formulations and methods could be used, for example, providing a benefit or sensation to an end user.

Provided herein is a device for generating an inhalable aerosol comprising; a detachable cartridge having a first heating element, a second heating element, a first compartment for containment of vaporizable material, and a second compartment for containment of vaporizable material, wherein the vaporizable material in the first compartment is the same or different as the vaporizable material in the second compartment, and a body having a battery and circuitry for controlling the device wherein the cartridge and body are coupled by a first connection mechanism.

The detachable cartridge comprises multiple compartments with at least one compartment having at least one heating element and at least one vaporizable material. The device is configured such that each compartment containing at least one resistive heating element also comprises a wicking material that is in direct contact with the vaporizable material in the compartment. At least one heating element in at least one compartment is exposed to an air passage in the cartridge.

At least one resistive heater in the cartridge is designed to reach a closely controlled target temperature, below the pyrolytic temperature of tobacco, and more specifically, a target "vapor temperature", greater than about 100° C., but less than about 300° C., intended to convert the vaporizable material of at least one compartment to a visible vapor, such as about 170° C. for flavorants, about 190° C. for nicotine, and about 210° C. for humectants.

In some embodiments, at least one resistive heater comprises wire coil wrapped around a wicking material (e.g. silica) that penetrates a moisture resistant liquid barrier of at least one compartment holding the vaporizable material and allows the vaporizable material to "wick" around the wire and be heated to a controlled temperature when activated. This occurs when the ends of wires traversing the length of the cartridge, exiting the compartment distally and connecting to the body, are activated by a mechanism, optionally a button mechanism, and circuitry connected to the battery in the body. Additionally, different wicking rates of the vaporizable material in the compartment is obtained using different wick materials and/or different arrangements of the heating element and the wick (e.g. heating element wrapped around the wick, heating element passing through the wick). Wicking materials at least comprise silica, cotton, stainless steel mesh, and Ekowool. Wicking properties, which effect wicking rates, include wicking material density, composition, dimension, shape, size, length, width, among others. One of ordinary skill in the art would recognize the relationship between wicking material properties and arrangements of the heating element and the wick and the effects on wicking rates.

In some embodiments wicking material of the first heating element is the same or different than the wicking material of the second heating element. Heating element material properties include heating element material composition, density, dimension, shape, size, length, width, among others. In some embodiments, the wicking material of the first heating element is the same as the wicking material of the second heating element and the wicking rate of the vaporizable material in the first compartment to at least one heating element is the same or different as the wicking rate of the vaporizable material in the second compartment to at least one heating element. In some embodiments, the wicking material of the first heating element is different than the wicking material of the second heating element, and the wicking rate of the vaporizable material in the first compartment to at least one heating element is the same or different as the wicking rate of the vaporizable material in the second compartment to at least one heating element.

In some embodiments the vaporizable material in the first compartment is the same as the vaporizable material in the second compartment, and the target temperature for the first heating element is the same or different as the target temperature for the second heating element. In some embodiments, the vaporizable material in the first compartment is different than the vaporizable material in the second compartment, and the target temperature for the first heating element is the same or different as the target temperature for the second heating element. Target temperatures at least comprise temperatures below the pyrolytic temperature of tobacco, greater than about 100° C. but less than about 300° C., about 170° C. for flavorants, about 190° C. for nicotine, about 210° C. for humectants, about 100° C., about 120° C., about 140° C., about 160° C., about 180° C., about 200° C., about 220° C., about 240° C., about 260° C., about 280° C., and about 300° C.

In some embodiments, the vaporizable material in the first compartment is the same as the vaporizable material in the second compartment, and the temperature range for the first heating element is the same or different than the temperature range for the second heating element. In some embodiments, the vaporizable material in the first compartment is different than the vaporizable material in the second compartment, and the temperature range for the first heating element is the same or different than the temperature range for the second heating element. Temperatures ranges at least comprise temperatures below the pyrolytic temperature of tobacco, greater than about 100° C. but less than about 300° C., about 170° C. for flavorants, about 190° C. for nicotine, about 210° C. for humectants, about 125° to about 255° C., about 150° to about 230° C., about 170° to about 210° C.

In some embodiments, the vaporizable material in the first compartment is the same as the vaporizable material in the second compartment, and the heating parameters for the first heating element is the same or different than the heating parameters for the second heating element. In some embodiments the vaporizable material in the first compartment is different than the vaporizable material in the second compartment, and the heating parameters for the first heating element is the same or different than the heating parameters for the second heating element. Heating parameters at least comprise target temperature, temperature range, heating duration, heating frequency, and heating control. One of ordinary skill in the art would recognize heating parameters that effect function of the aerosol generating devices described herein.

In some embodiments, the resistive heater elements within at least one compartment for containment of vaporizable material are "breath-activated" when the user puffs on the device. This activation mode is accomplished by vacuum activated contact switches and or solid state pressure sensors and circuitry connected to the battery in the attachable body.

In still other embodiments, at least one resistive heater element within at least one compartment for containment of vaporizable material is selectively activated when the user picks up the device. This activation mode is accomplished by a button mechanism, an accelerometer, and/or solid state sensors and circuitry connected to the battery in the attachable body. The selective activation cycle has several modes including but not limited to a "preheat" setting for the resistive heaters that brings the temperature of at least one resistive heater up to a "pre-vaporization" temperature (e.g.: 100°-130° C.); a sleep mode where the device deactivates and shuts down after a short period of time; or an "off" mode when no use or movement is detected for a longer period of time, or the user manual changes the mode and/or deactivates the device with the button.

In some embodiments, at least one resistive heater wire is inserted through or surrounded by wicking material in direct contact with one of the compartments containing vaporizable material. The ends of wires traverse the length and exit the compartment distally where they attach to a first connection mechanism in the distal end of the cartridge that matches a second connection mechanism on the body.

In some embodiments, the detachable cartridge is a single-unit construction wherein the entire cartridge with all of its components, are replaced en masse.

In some embodiments, the detachable cartridge is a modular construction wherein the first and/or second compartments containing vaporizable material and a heater, or combinations of multiple compartments, each containing vaporizable material and a heater, are removable. In some embodiments, the individual compartments and heaters are arranged in a stacked-series configuration, a parallel configuration, a concentric configuration, or any combination of series-stacked, parallel or concentric configuration within the detachable cartridge.

In some embodiments, the individual compartments containing the vaporizable materials and heaters within the cartridge are removable and replaceable. In still other embodiments the individual compartments containing the vaporizable materials and heaters within the cartridge are interchangeable with replacement components. In some embodiments, the individual compartments containing the vaporizable materials and heaters within the cartridge are recyclable and reusable and is refilled by the user.

In some embodiments, the device comprises different connection mechanisms between the detachable cartridge and the body. In some embodiments, the connection mechanisms comprise; a threaded connection, a tapered connection, a magnetic connection, a spring-loaded connection, a spring detent connection, a snap-fit connection, a compression connection, or any combination thereof.

In some embodiments, the body also comprises at least one push button for operator control of the circuitry. In some embodiments, the body also comprises at least one LED indicator to apprise the user of a functional operation of the device.

In some embodiments the battery is not rechargeable. In some embodiments the battery is rechargeable. In some embodiments the battery is a lithium-based rechargeable battery. In some embodiments the attachable body comprises a mechanism for recharging the battery.

In some embodiments the device is configured to further comprise a detachable mouthpiece, wherein the mouthpiece is the detachable cartridge. In some embodiments the mouthpiece has at least one air passage therethrough and at least one heating element is exposed to the air passage. In some embodiments the detachable mouthpiece cartridge is a single-unit, non-modular construction. In some embodiments the compartments for containment of vaporizable material are aligned in series within the detachable mouthpiece cartridge, are aligned in parallel within the detachable mouthpiece cartridge, are aligned concentrically within the detachable mouthpiece cartridge, and/or are aligned in any combination of series stacking, concentric, and parallel alignment within the detachable mouthpiece cartridge.

Figure 4:
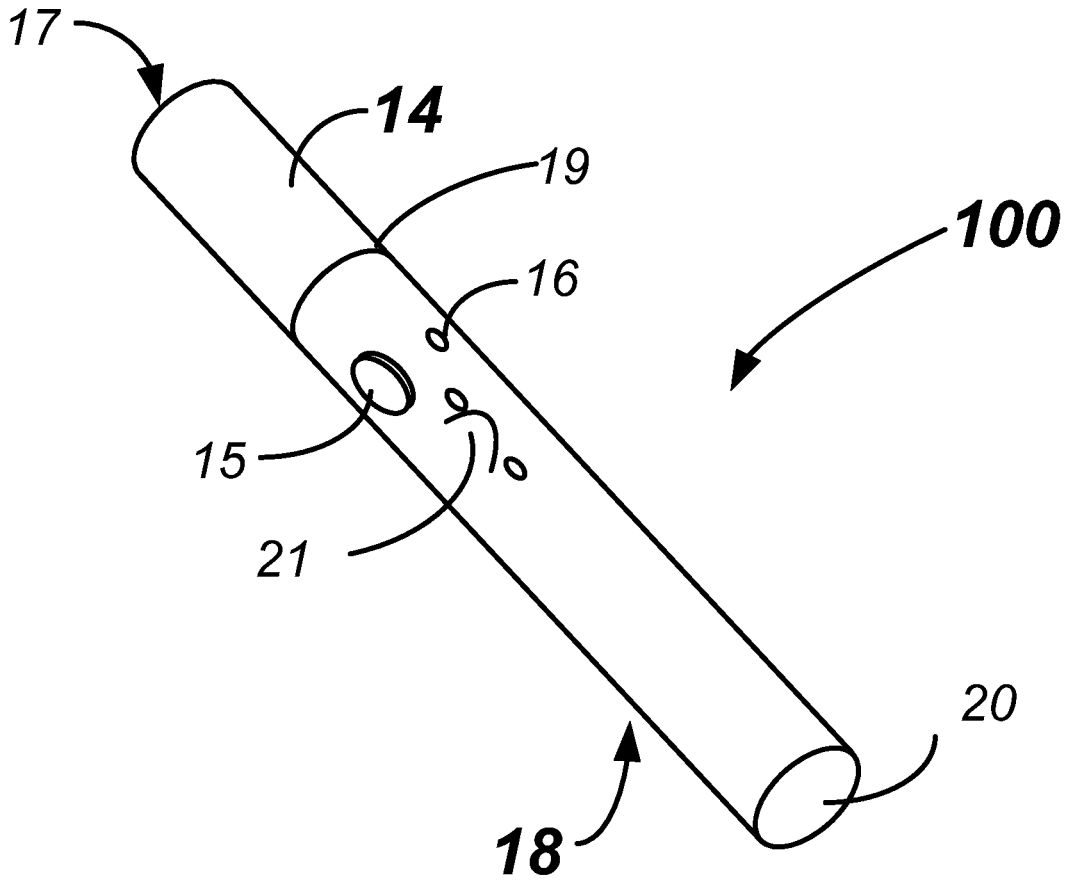
FIG. 4 illustrates an isometric representation of the invention with dimensions and aspect ratio similar to a conventional cigarette.

Provided herein is a device for generating an inhalable aerosol comprising; a detachable cartridge having a first heating element, a second heating element, a first compartment for containment of vaporizable material, and a second compartment for containment of vaporizable material, wherein the vaporizable material in the first compartment is the same or different as the vaporizable material in the second compartment; and an attachable body having a battery and circuitry for controlling the device wherein the detachable cartridge and body are coupled by a first connection mechanism. An exemplary device 100 is illustrated in FIG. 4 comprising a detachable cartridge 14, having an air outlet 17, internal compartments for containment of vaporizable material (not shown), heating elements (not shown), at least one air inlet (not shown), and a first connection mechanism 19. Also included is a body 18 comprising an activation button 15, an air inlet 16, a second connection mechanism 19, an optional glow indicator LED 20, a mode indicator LED 21, an internal battery (not shown), an optional accelerometer (not shown), and internal circuit board and circuitry (not shown). In some embodiments a detachable mouthpiece comprises the cartridge 14. In some embodiments a detachable mouthpiece is the cartridge 14.

Figure 6:
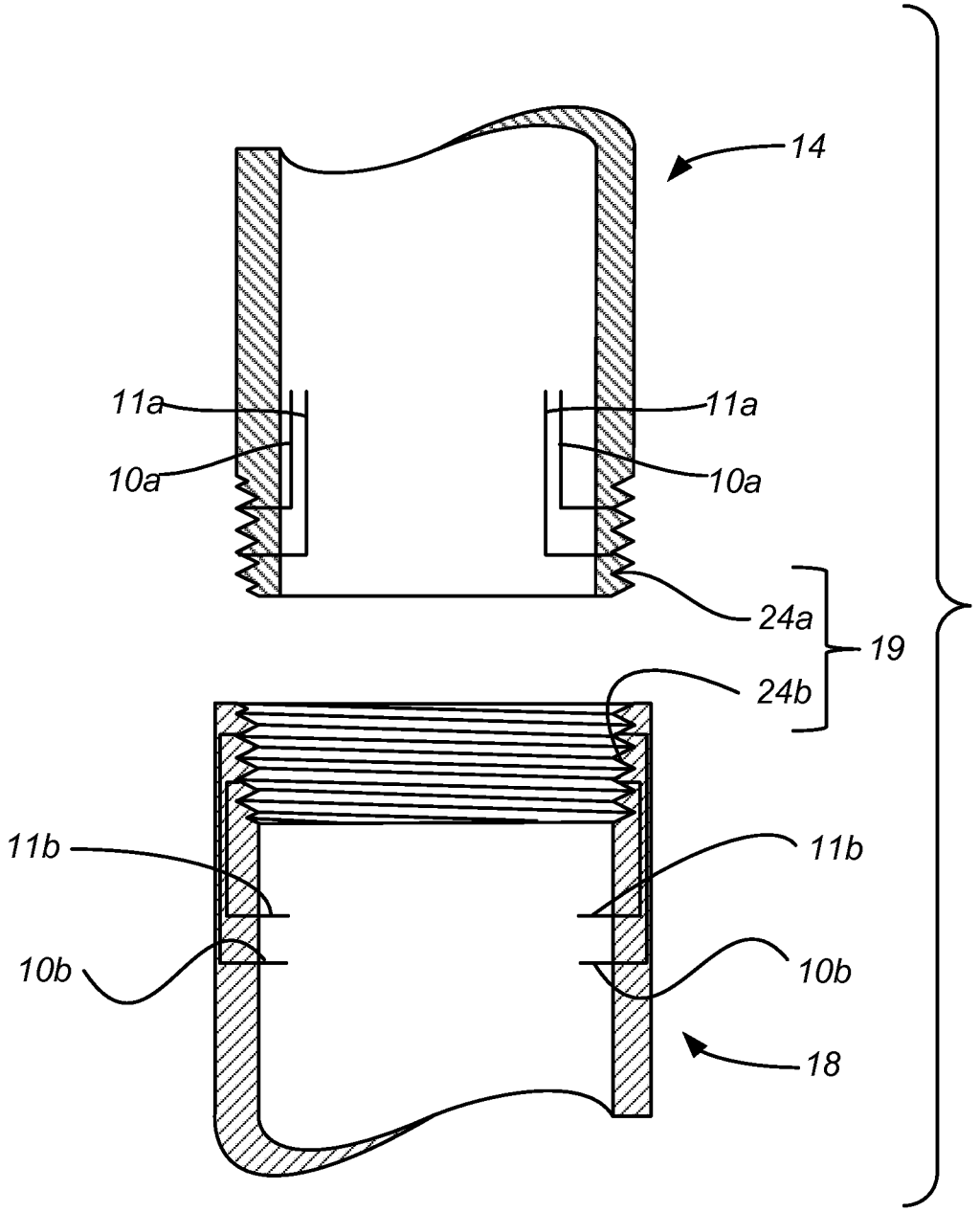
FIGS. 6, 7 & 8 illustrate representative examples of possible connection mechanisms for the inventive device.
Figure 7:
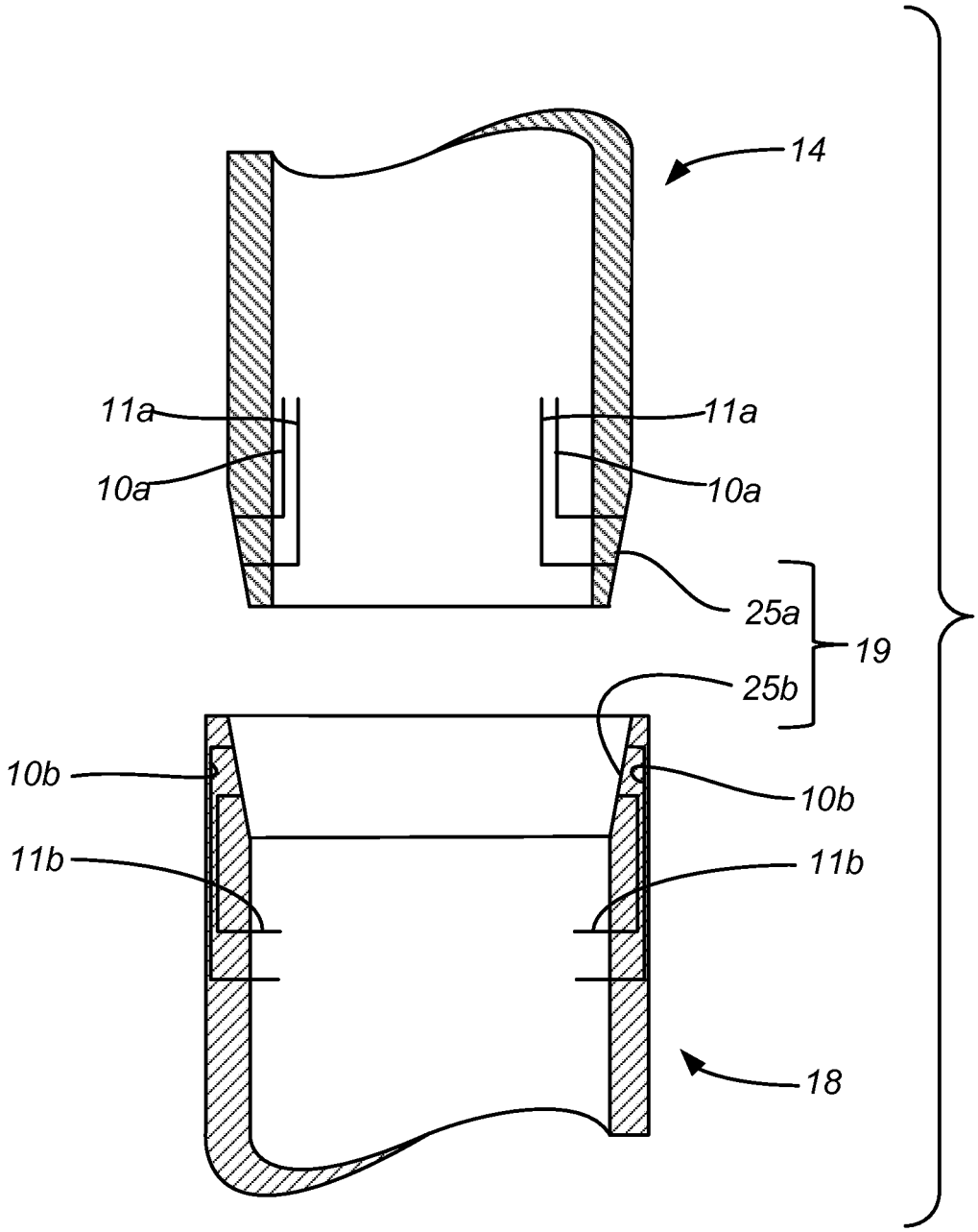
Figure 8:
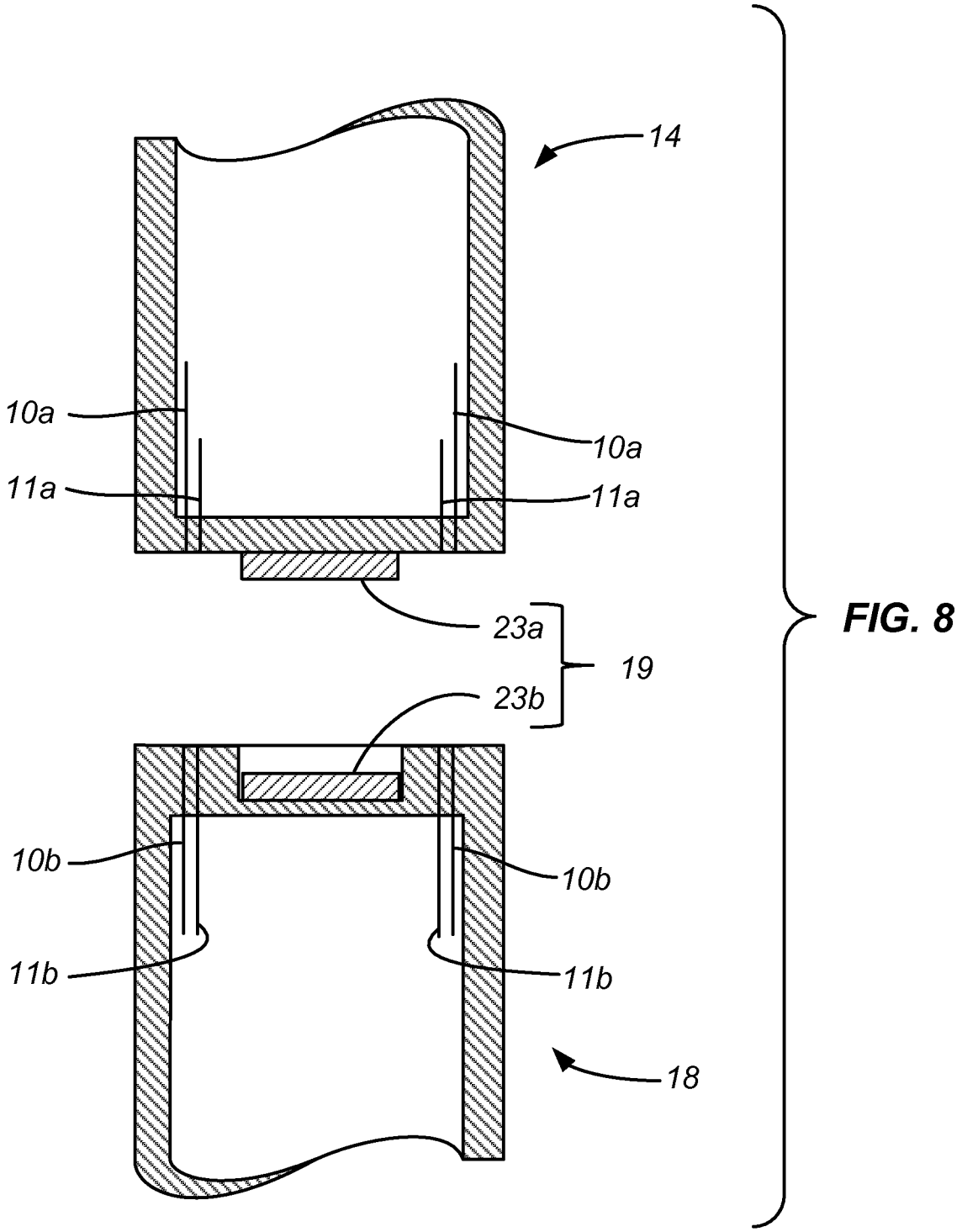

As shown in FIG. 4, the halves of the exemplary device form a separable, but firm connection 19 and resemble a typical cigarette in appearance. The connection mechanism 19, also interchangeably referred to as an attachment mechanism, is achieved in numerous ways. As shown in FIGS. 6, 7, 8, an attachment mechanism 19 may include and be herein represented by, but are not limited to, a threaded connection 24*a*, 24*b*, a tapered connection 25*a*, 25*b*, a magnetic connection 23*a*, 23*b*, as illustrative examples, or, a spring-loaded connection (not shown), a spring detent connection (not shown), a snap-fit connection (not shown), a compression connection (not shown), or any combination thereof. In some instances, the device 100 is manufactured as a single-use inseparable outer body. In some embodiments, the single button interface 15 provides the mechanism for on, off and wake from sleep. Alternatively, an accelerometer (not shown), provides the mechanism for on, off and wake from sleep. In some embodiments, the single button interface also provides the mechanism for selection of specific heater activation within the cartridge. In some embodiments, (not shown) additional buttons are included for any of these functions. For example, pressing the single button for 1 second turns the device on. Continuing to hold the button for 5 seconds disables the motion-based low power standby and automatic shut-down. Alternatively, a second button is used to disable the motion-based low power standby and and/or shut-down. In some embodiments, upon power-up, if the single button is depressed for a very long period (>10 seconds), the device turns off again. This is to prevent inadvertent activation while in a purse, etc. While on, pressing the button momentarily turns it off. In some embodiments, a single or more than one button could report battery level (via LED blinks, for instance), change operating temperature of the device, or change the nominal intensity of the LED(s)—if the user is in a dark environment and does not want the light to be distracting. These various features could be triggered with one or more buttons or with the same button by pressing it for a prescribed duration or number of presses.

Provided herein is a device for generating an inhalable aerosol, comprising; a detachable cartridge having a first heating element, a second heating element, a first compartment for containment of vaporizable material, and a second compartment for containment of vaporizable material, wherein the vaporizable material in the first compartment is the same or different as the vaporizable material in the second compartment; and a body having a battery, at least one activation button, and circuitry for controlling the device, wherein the device comprises a first capacitive sensor coupled to the circuitry. In some embodiments, a surface or shell of the device triggers the first capacitive sensor upon a user input to the surface or shell of the device. In some embodiments, a capacitive sensing surface of the first capacitive sensor detects when a user is holding the device, causing the device to indicate that the device is in use or a ready state. In some embodiments, the circuitry causes the heating elements to enter a pre-heat state upon activation or triggering of the first capacitive sensor. In some embodiments, the device exits the pre-heat state or turns off when the first capacitive sensor no longer detects movement of the device. In some embodiments, a surface of the device comprises two electrically isolated capacitive sensing zones wherein the first zone comprises s first capacitive sensor, and the second zone comprises a second capacitive sensor. In some embodiments, when a user contacts a first zone, the device indicates to the user that the device is in use or in a ready state. In some embodiments, the device indicates use or ready state by displaying a pattern of one or more LED(s), displaying a predetermined color of one or more LED(s), or provides an audio signal. In some embodiments, the zones are configured such that when a user touches one of the zones in a predetermined pattern of one or more touches, the device displays a charge level of the battery with a pattern of one or more LED(s) or with a color of one or more LED(s), or with an audio signal. In some embodiments, the zones are configured such that when a user swipes a finger from the first zone to the second zone, or from the second zone to the first zone, the device displays a charge level of the battery with a pattern of one or more LED(s) or with a color of one or more LED(s), or with an audio signal. In some embodiments the device is configured to further comprise a detachable mouthpiece, wherein the mouthpiece is the detachable cartridge. In some embodiments the mouthpiece has at least one air passage therethrough and at least one heating element is exposed to the air passage. In some embodiments the detachable mouthpiece cartridge is a single-unit, non-modular construction. In some embodiments the compartments for containment of vaporizable material are aligned in series within the detachable mouthpiece cartridge, are aligned in parallel within the detachable mouthpiece cartridge, are aligned concentrically within the detachable mouthpiece cartridge, and/or are aligned in any combination of series stacking, concentric, and parallel alignment within the detachable mouthpiece cartridge. In some embodiments, touching the device to lips of a user activates a second capacitive sensor coupled to the circuitry whereby the device heating elements enter a pre-heat state. In some embodiments, when the user inhales the heating elements get fully activated and generate aerosol that is deliverable to the user by such inhalation or by additional inhalation. In some embodiments, inhalation activates a pressure switch to fully activate the heater elements. In some embodiments, the device comprises a button or touch sensor that when pushed or touched fully activates the heater elements and generates aerosol that is deliverable to a user by inhalation thereby.

As described herein and further shown in FIG. 1, one exemplary illustration of the detachable cartridge 14 comprises a shell or outer housing 2, having a single central airpath 1 therethrough with an air inlet 26 and air outlet, 17, and a first and second stacked compartments 114, 214, respectively, each surrounded by a liquid barrier 13, and filled with an absorbent batting material 6, 7 that will absorb and hold a first and second vaporizable material. The vaporizable materials in the stacked compartments 114, 214 is the same or different. Also within each cartridge, and centered within the central airpath is a first and second resistive heater element 3, 4, respectively. One exemplary design of these resistive heater elements 3, 4 include wire coils 31, 41 wrapped around a silica wick 9. The wire coils 31, 41 are coupled to heater circuit wires 10, 11 (alternatively called heater wires herein), which deliver energy to the coils 31, 41 which results in the coils heating up and aerosolizing the liquid vaporizable material wicked by the wicking material 9 from their respective compartments 114 or 214. While the wires 10, 11 are described herein as being coupled to coils 31, 41, other designs of these heating elements are contemplated herein which would be obvious to one of ordinary skill in the art upon reading the disclosure herein. Further, other wick materials are envisioned and must be capable of withstanding the target temperatures generated by the resistive heating element, without changing the flavor of the vapor or imparting an undesirable taste to the end user. The wicking material 9, extends through the inner liquid barrier walls 13, along with the heater circuit wires 10, 11 for the resistive heater elements 3, 4. This provides a steady and even flow of liquid vaporizable material to the resistive heater elements 3, 4 until the vaporizable material within at least one compartment is exhausted. Immediately proximal to each heater element 3, 4, and in the central airpath, is an atomizing chamber 61, 62 where the vapor generated from the heating element will form and mix with inlet air and the vapors formed from any previous heating elements in the airpath 1. In addition, the heater element circuit wires 10, 11 may extend either through, or along side of, adjacent compartments 114, 214 until they reach the first connection mechanism (not shown) at the distal end of the detachable cartridge 14. The wires then couple to the circuitry of the device which controls the activation and other features of the heater elements, and thus control the timing, delivery, contents, and amount, at least, of the vapor or aerosol deliverable to the user. In some embodiments a detachable mouthpiece comprises the cartridge 14. In some embodiments a detachable mouthpiece is the cartridge 14.

Figure 2:
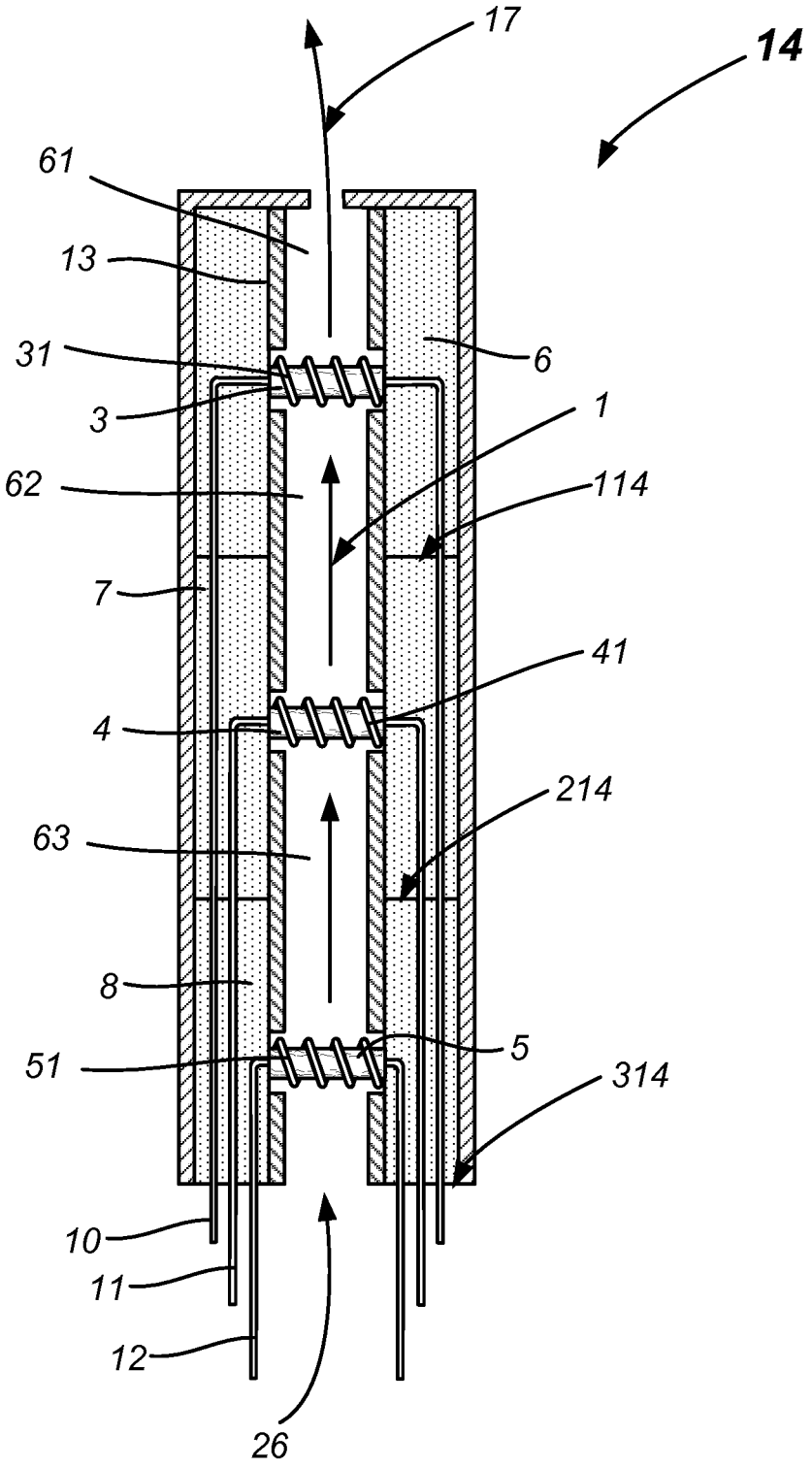
FIG. 2 illustrates a sectional view of a detachable cartridge having a second heating element, a third heating elements, a first compartment for containment of vaporizable material, a second compartment for containment of vaporizable material, and a third compartment for containment of vaporizable material.

In some embodiments of the detachable cartridge 14, as shown in FIG. 2, the cartridge 14 comprises a shell or outer housing 2, having a single central airpath 1 therethrough, a first, second and third stacked compartments 114, 214, and 314, respectively, each surrounded by a liquid barrier 13, and filled with an absorbent batting material 6, 7, and 8 that will absorb and hold a first, second and third vaporizable material. The vaporizable material in the first, second and third compartments is the same or different. Also within each cartridge, and centered within the central airpath is a first, second, and third resistive heater element 3, 4, and 5, respectively. As described previously, an exemplary design of these resistive heater elements 3, 4, and 5 include wire coils 31, 41, and 51 wrapped around a silica wick 9. The wicking material 9, extends through the inner liquid barrier walls 13, along with the circuit wires 10, 11, and 12 for the resistive heater elements 3, 4 and 5. This provides a steady and even flow of liquid vaporizable material to the resistive heater elements 3, 4 and 5 until the vaporizable material within at least one compartment 114, 214, 314 is exhausted. Immediately proximal to each heater coil 31, 41, and 51, and in the central airpath, is an atomizing chamber 61, 62 and 63 where the vapor generated from the heating element will form and mix with inlet air and the vapors formed from any previous heating elements in the airpath 1. In addition, the heater element circuit wires 10, 11, and 12 may extend either through, or along side of, adjacent compartments 114, 214, and 314 until they reach the first connection mechanism (not shown) at the distal end of the detachable cartridge 14. In some embodiments a detachable mouthpiece comprises the cartridge 14. In some embodiments a detachable mouthpiece is the cartridge 14.

Figure 3:
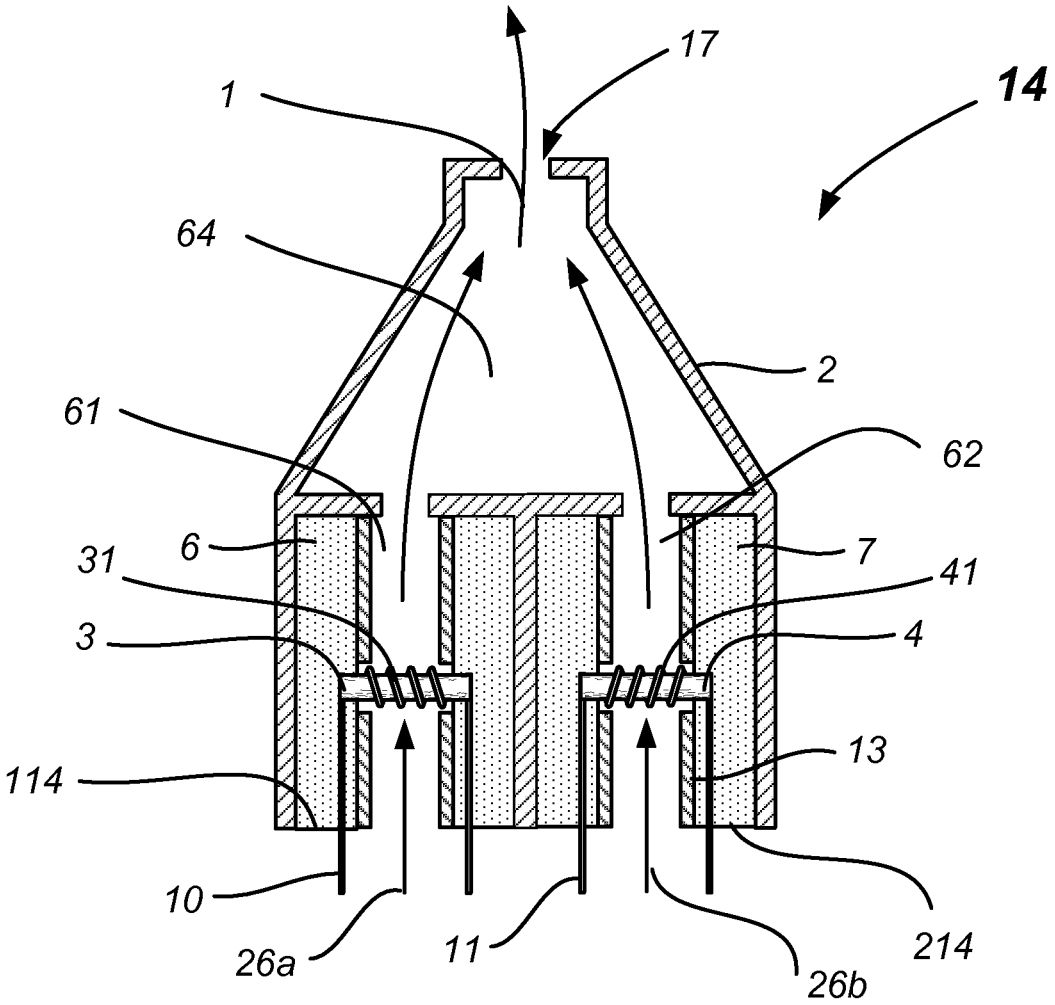
FIG. 3 illustrates a sectional view of a detachable cartridge having two heating elements and two compartments for containment of vaporizable material in a parallel or concentric configuration.

Still further, an additional exemplary illustration of the detachable cartridge 14 as shown in FIG. 3 comprises a shell or outer housing 2, having multiple air inlets 26*a*, 26*b*, etc., and compartments, ultimately culminating into a single central airpath 1 at the air outlet, 17. The illustrative embodiment comprises two parallel or circumferentially located compartments 114, 214, respectively, however, one skilled in the art will recognize that there may be multiple circumferentially-located compartments; (e.g.: 3, 4, 5, etc.). The vaporizable material in the first and second compartments is the same or different. The vaporizable material in multiple compartments is the same or different. In some embodiments a detachable mouthpiece comprises the cartridge 14. In some embodiments a detachable mouthpiece is the cartridge 14.

The illustrative embodiment in FIG. 3 comprises two parallel or circumferentially located compartments 114, 214, each surrounded by a liquid barrier 13, and filled with an absorbent batting material 6, 7 that will absorb and hold a first and second vaporizable material. Also within each cartridge, and centered within the respective airpaths 26*a*, 26*b* is a first and second resistive heater element 3, 4. As described previously, the exemplary design of these resistive heater elements 3, 4 include wire coils 31, 41 wrapped around a silica wick 9. The wicking material 9 extends through the inner liquid barrier walls 13, along with the circuit wires 10, 11 for the resistive heater elements 3, 4. This provides a steady and even flow of liquid vaporizable material to the resistive heater elements 3, 4 until the vaporizable material within at least one compartment 114, 214 is exhausted. Immediately proximal to each coil 31, 41, and in the respective airpath, is an atomizing chamber 61, 62 where the vapor generated from the heating element will form and mix with inlet air from the air inlets 26*a*, 26*b*. Ultimately, the airpaths converge into a central atomizing chamber 64 within a single airpath 1, where the vapors mix before exiting through the air outlet 17. In addition, the heater element circuit wires 10, 11 extend through or along side of adjacent compartments 114, 214 until they reach the first connection mechanism (not shown) at the distal end of the detachable cartridge 14. In some embodiments a detachable mouthpiece comprises the cartridge 14. In some embodiments a detachable mouthpiece is the cartridge 14.

As illustrated in FIGS. 6, 7, and 8 and briefly described previously, a plurality of connection mechanisms are contemplated for the device which comprise threaded connections 24*a*, 24*b*, tapered connections 25*a*, 25*b*, magnetic connections 23*a*, 23*b*, as illustrative examples, or, a spring-loaded connection (not shown), a spring detent connection (not shown), a snap-fit connection (not shown), a compression connection (not shown), or any combination thereof. The connectors shown in FIGS. 6, 7, and 8 could be part of a detachable cartridge and/or a mouthpiece comprising a detachable cartridge.

FIGS. 6 and 7 illustrate non-limiting examples for a threaded connection 24*a*, 24*b* and (Morse) taper connection 25*a*, 25*b* respectively where the heater circuit wires 10*a*, 11*a*, (and 12*a* in a 3-heater element design), could be inserted along the inner diameters to specific longitudinal locations corresponding to the mating connections 10*b*, 11*b*, (and 12*b* in a 3-heater element design), in the attachable body (electronics and battery module). Similarly, FIG. 8 illustrates a simple butted-end connection, with a pair of magnets 23*a*, 23*b*, (or a single magnet 23 and conductive counter-sunk mating endplate. The heater circuit wires 10*a*, 11*a* could be inserted at various aligned point locations on the mating end corresponding to the mating connections 10*b*, 11*b* in the attachable body (electronics and battery module).

One skilled in the art will quickly recognize that based on the description herein, any combination of cartridge and heater element circuit arrangement as described herein would be possible for alternative cartridge embodiments.

One skilled in the art will quickly recognize that based on the description herein, any combination of mouthpiece, cartridge and heater element circuit arrangement as described herein would be possible for alternative mouthpiece and/or cartridge embodiments.

Provided herein is a device 100 as shown in FIGS. 1, 2, 3 and 5 for generating an inhalable aerosol comprising; a removable cartridge 14 having a proximal end and a distal end, wherein, the removable cartridge 14 comprises; an outer shell 2, a first connection mechanism 19 at the distal end, at least one air inlet in the distal end 26, a first heating element 3 with circuitry 10, a second heating element with circuitry 11, a first compartment containment of vaporizable material 114, a second compartment containment of vaporizable material 214, wherein the vaporizable material in the first compartment 114 is the same or different as the vaporizable material in the second compartment 214, at least one airpath 1 therethrough having exposure to at least one compartment for containment of vaporizable material 114, 214 and at least one heating element 3, 4, comprising heating coils 31, 41, a liquid barrier 13 to isolate the vaporizable materials within at least one compartment and from at least one airpath, an air outlet 17 at the proximal end; and a body 18 having a proximal end and a distal end, coupleable to the cartridge with a second connection mechanism 19; wherein, the body comprises; an outer shell 2, the second connection mechanism 19 at the proximal end, an air inlet in the outer shell 16, at least one indicator light or mode indicator LED 20, 21, a battery 70, circuitry 80, 90 for controlling the device, at least one operator-controlled push-button 15 connected to the circuitry through the outer shell, and an air outlet 27 in the proximal end. In some embodiments a detachable mouthpiece comprises the cartridge 14. In some embodiments a detachable mouthpiece is the cartridge 14.

In some embodiments, the device for generating an inhalable aerosol is an electronic cigarette 100. In some embodiments, the device for generating an inhalable aerosol is an electronic cigar (not shown). In some embodiments, the device for generating an inhalable aerosol is an electronic pipe (not shown). In some embodiments, the device for generating an inhalable aerosol is an electronic water-cooled smoking apparatus (not shown).

Still further, the removable cartridge 14 comprises at least one atomizing chamber 61, 62, 63, 64 adjacent and proximal to the resistive heating elements 3, 4, 5 and heater coils 31, 41, 51. In some embodiments a detachable mouthpiece comprises the cartridge 14. In some embodiments a detachable mouthpiece is the cartridge 14.

In some embodiments, the vaporizable material is a liquid, a gel, a viscous material, a temperature sensitive mesophase material.

Figure 5:
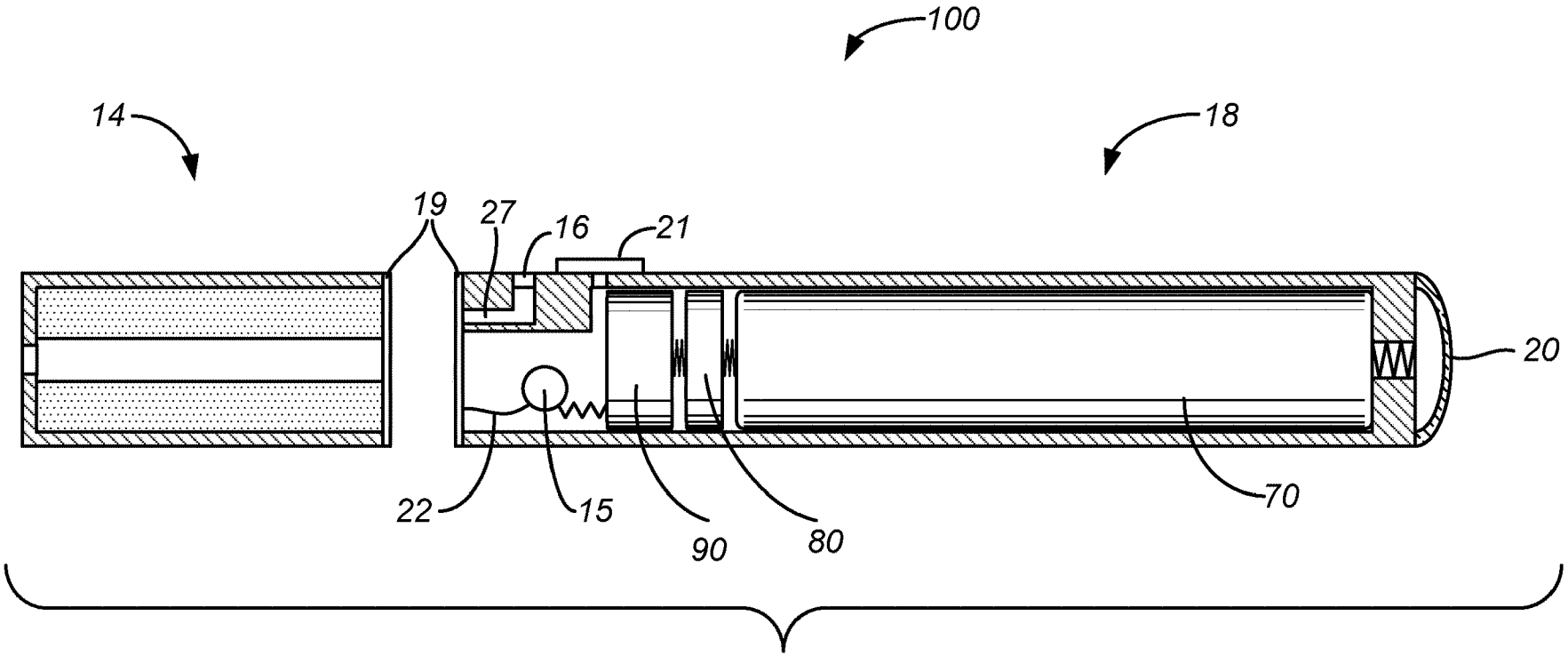
FIG. 5 illustrates a representative sectional view of the inventive device described in FIG. 4.

As shown in the representative body/electronics and battery module cross-section of FIG. 5, in some embodiments of the device, the circuitry controls the selection of the electronic heaters to be activated. This may be accomplished in a number of ways, including but not limited to push button controls 15, having power supply wires 22 for coupling to the heater wires extending to the first connection mechanism 19, pressure sensitive or solid state pressure switches (not shown), a circuit board (alternatively called circuitry or control circuitry herein) 80, or an accelerometer 90 to name a few.

In some embodiments of the device, the compartments for containment of vaporizable material contain nicotine, flavorants, humectants, or water.

In some embodiments of the device, the compartments for containment of vaporizable material 114, 214, 314 with individual resistive heating elements 3, 4, 5, respectively, are prefilled with the same or different vaporizable material. In some embodiments of the device, the compartments for containment of vaporizable material 114, 214, 314, with individual resistive heating elements 3, 4, 5, respectively, is filled by the user with the same or different vaporizable material. In some embodiments of the device, the compartments for containment of vaporizable material 114, 214, 314, with individual resistive heating elements 3, 4, 5, respectively, are recyclable and/or reusable.

In some embodiments of the device, a mouthpiece comprises the compartments for containment of vaporizable material 114, 214, 314 with individual resistive heating elements 3, 4, 5, respectively, are prefilled with the same or different vaporizable material. In some embodiments of the device, the compartments for containment of vaporizable material 114, 214, 314, with individual resistive heating elements 3, 4, 5 is filled by the user with the same or different vaporizable material. In some embodiments of the device, the compartments for containment of vaporizable material 114, 214, 314, with individual resistive heating elements 3, 4, 5, respectively, are recyclable and/or reusable.

In some embodiments of the device, the compartments for containment of vaporizable material 114, 214, 314, with individual resistive heating elements 3, 4, 5 are replaceable and the housing is reusable.

In some embodiments of the device, a mouthpiece comprises the compartments for containment of vaporizable material 114, 214, 314, with individual resistive heating elements 3, 4, 5, respectively, are replaceable and the mouthpiece is reusable.

In some embodiments of the device, the cartridge comprising the compartments for containment of vaporizable material are available in 2-element modules 114, 214; 3-element modules 114, 214, 314; or multi-element modules 114, 214, 314, . . . "x14".

In some embodiments of the device, a detachable mouthpiece comprises a cartridge comprising the compartments for containment of vaporizable material, wherein the mouthpiece is available in 2-element modules 114, 214; 3-element modules 114, 214, 314; or multi-element modules 114, 214, 314, . . . "x14". In some embodiments of the device, a detachable mouthpiece comprises a cartridge comprising the compartments for containment of vaporizable material, wherein the cartridge comprising the compartments for containment of vaporizable material are available in 2-element modules 114, 214; 3-element modules 114, 214, 314; or multi-element modules 114, 214, 314, . . . "x14"

In still other embodiments of the device the target temperatures for the heating elements 3, 4, 5 is below the combustion temperature for tobacco. In still other embodiments of the device the target temperatures for the heating elements 3, 4, 5 is below the pyrolysis temperature for tobacco. More specifically, a target "vapor temperature" is greater than about 100° C., but less than about 300° C., intended to convert the vaporizable material of at least one compartment to a visible vapor. In some embodiments of the device, the target temperature for the heating elements for nicotine is about 190° C. In some embodiments of the device, the target temperature for the heating elements for flavorants is about 170° C. In some embodiments of the device, the target temperature for the heating elements for humectants is about 210° C.

Still further, in some embodiments the circuitry includes an accelerometer 90 as previously noted and shown in FIG. 5. In some embodiments the accelerometer functions comprise; determining if a user is actively using the device, providing a pre-heat condition for the heating elements, providing a battery power level feedback of the device to the user, providing user with a mechanism to change available modes of the device, providing an automatic activation mode when the device is picked up by the user, providing an automatic sleep mode when the device is inactive for a period of time. Direct visual feedback is provided to the user through the use of at least one LED light indicator 20, or Mode indicator 21.

Provided herein is a device for generating an inhalable aerosol, comprising; a detachable cartridge comprising, a first heating element, a second heating element, a first compartment for containment of vaporizable material, and a second compartment for containment of vaporizable material, wherein the vaporizable material in the first compartment is the same or different as the vaporizable material in the second compartment; and a body having a battery, an activation button, and circuitry for controlling the device, wherein the device generates an aerosol substantially free from at least one Hoffman analyte upon heating the vaporizable material to a target temperature. In some embodiments the device is configured to further comprise a detachable mouthpiece, wherein the mouthpiece is the detachable cartridge. In some embodiments the mouthpiece has at least one air passage therethrough and at least one heating element is exposed to the air passage. In some embodiments the detachable mouthpiece cartridge is a single-unit, non-modular construction. In some embodiments the compartments for containment of vaporizable material are aligned in series within the detachable mouthpiece cartridge, are aligned in parallel within the detachable mouthpiece cartridge, are aligned concentrically within the detachable mouthpiece cartridge, and/or are aligned in any combination of series stacking, concentric, and parallel alignment within the detachable mouthpiece cartridge.

In some embodiments, the Hoffman analyte is selected from the group consisting of: ammonia, aminonaphthalenes, benzopyrene, formaldehyde, acetaldehyde, acetone, methyl ethyl ketone, butyraldehyde, hydrogen cyanide, nitrous oxides, tobacco-specific nitrosamines (TSNAs), pyridine, quinoline, hydroquinone, phenol, cresols, tar, nicotine, carbon monoxide, 1,3-butadiene, isoprene, acrylonitrile, benzene, toluene, and styrene. In some embodiments, the aerosol comprises particles less than about 2 microns in diameter. In some embodiments, the device generates an aerosol upon heating a vaporizable material to a target temperature with at least 70% less Hoffman analytes than a common tobacco cigarette. In some embodiments, the device generates an aerosol comprising particles less than about 2 microns in diameter.

Provided herein is a method of delivering an aerosol substantially free from a Hoffman analyte to a subject comprising; deploying an aerosol generating device a first heating element, a second heating element, a first compartment for containment of vaporizable material, and a second compartment for containment of vaporizable material, wherein the vaporizable material in the first compartment is the same or different as the vaporizable material in the second compartment; and heating the vaporizable materials with at least one heating element of the device to a target temperature to generate an aerosol; and delivering the aerosol to the subject for inhalation.

In some embodiments of the method, the aerosol comprises particles less than about 2 microns in diameter.

Provided herein is a device for generating an aerosol from a vaporizable material wherein the aerosol contains at least 70% less Hoffman analytes than a substance generated by burning a tobacco material.

Provided herein is a device for generating an aerosol from a vaporizable material wherein the device generates an aerosol from a vaporizable material wherein the vapor generated by the device yields a non-mutagenic Ames test result.

Provided herein is a device for generating an aerosol from a vaporizable material wherein the aerosol vapor scores significantly better on the Ames test than a substance generated by burning a tobacco material.

Provided herein is a device for generating an aerosol from a vaporizable material wherein the device provides an aerosol for inhalation to a user for at least three non-continuous hours without servicing the device.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An apparatus for generating an inhalable aerosol, the apparatus comprising:

a cartridge comprising:

a first compartment configured to store a first vaporizable material, the first compartment comprising a first airflow path, the first compartment comprising a first chamber comprising the first airflow path, a first heating element configured to vaporize the first vaporizable material to form a first vapor, a second compartment configured to store a second vaporizable material, the second compartment comprising a second airflow path that is in communication with the first airflow path, the second compartment comprising a second chamber comprising the second airflow path, a second heating element configured to vaporize the second vaporizable material to form a second vapor, the second vapor introduced to the first vapor in the second chamber, and a mating end comprising a first plurality of contacts and a second plurality of contacts, the first plurality of contacts electrically coupled to the first heating element, the second plurality of contacts electrically coupled to the second heating element; and a body comprising:

a battery, a first mating connection configured to electrically couple the first plurality of contacts and the first heating element with the battery, a second mating connection configured to electrically couple the second plurality of contacts and the second heating element with the battery, circuitry configured to control the first heating element to heat the first vaporizable material, the circuitry further configured to control the second heating element to heat the second vaporizable material, and at least one pressure sensor coupled to the circuitry, the pressure sensor configured to detect inhalation by the user, the circuitry configured to control, in response to the at least one pressure sensor detecting inhalation by the user, the first heating element to heat the first vaporizable material to a target temperature, wherein the body is configured to detachably couple to the mating end of the cartridge.

2. The apparatus of claim 1, wherein the first heating element comprises a first heater circuit wire, and wherein the second heating element comprises a second heater circuit wire.

3. The apparatus of claim 2, further comprising a first wicking material, wherein the first heater circuit wire comprises a first end and a second end, wherein the first heater circuit wire is in contact with the first wicking material, and wherein the first wicking material is in fluid communication with the first vaporizable material.

4. The apparatus of claim 3, comprising a second wicking material, wherein the second heater circuit wire comprises a third end and a fourth end, the second heater circuit wire in contact with the second wicking material, and wherein the second wicking material is in fluid communication with the second vaporizable material.

5. The apparatus of claim 4, wherein the first wicking material and the second wicking material have different material properties.

6. The apparatus of claim 4, wherein the first wicking material and the second wicking material have different wicking properties.

7. The apparatus of claim 1, wherein the first compartment and the second compartment are in series within the detachable cartridge relative to an airflow path.

8. The apparatus of claim 1, wherein the first compartment and the second compartment share a common axis within the detachable cartridge.

9. The apparatus of claim 8, wherein the common axis is aligned with a central axis of an airflow path.

10. The apparatus of claim 1, wherein the first compartment and the second compartment are stacked or aligned around a central axis, within the detachable cartridge.

11. The apparatus of claim 1, wherein the first compartment and the second compartment are replaceable with a third compartment or a fourth compartment in the cartridge.

12. The apparatus of claim 1, further comprising a first capacitive sensing zone and a second capacitive sensing zone, wherein the first capacitive sensing zone is electrically isolated from the second capacitive sensing zone, and wherein the first and second capacitive sensing zones are configured so that when a user swipes a finger from the first capacitive sensing zone to the second capacitive sensing zone, or from the second capacitive sensing zone to the first capacitive sensing zone, the apparatus communicates information to the user, the information comprising, a battery charge level, a vaporizable material level, a pre-heat state, or a combination thereof.

13. The apparatus of claim 1, further comprising a first capacitive sensing zone and a second capacitive sensing zone, wherein the first capacitive sensing zone is electrically isolated from the second capacitive sensing zone, and wherein the first and second capacitive sensing zones are configured so that when a user swipes a finger from the first capacitive sensing zone to the second capacitive sensing zone or from the second capacitive sensing zone to the first capacitive sensing zone, the apparatus is activated.

14. The apparatus of claim 1, wherein the circuitry is configured to selectively activate the first heating element and the second heating element in response to user input via at least one of a button interface, a capacitive sensor, and an accelerometer.

15. The apparatus of claim 1, wherein the second heating element is configured to heat the second vaporizable material to a second target temperature different from the first target temperature.

16. The apparatus of claim 15, wherein the first vaporizable material comprises nicotine, wherein the first target temperature is between about 100° C. and about 190° C., wherein the second vaporizable material comprises humectants, and wherein the second target temperature is between about 100° C. and about 210° C.

17. The apparatus of claim 15, wherein the first vaporizable material comprises nicotine, wherein the first target temperature is between about 100° C. and about 190° C., wherein the second vaporizable material comprises flavorants, and wherein the second target temperature is between about 100° C. and about 170° C.

18. The apparatus of claim 15, wherein the first vaporizable material comprises nicotine, wherein the first target temperature comprises a temperature at which the first vaporizable material converts to vapor, and wherein the first target temperature is below the pyrolytic temperature of tobacco.

19. The apparatus of claim 15, wherein the first vaporizable material comprises nicotine, wherein the first target temperature comprises a temperature at which the first vaporizable material converts to vapor, and wherein the first target temperature is below the combustion temperature of tobacco.

20. The apparatus of claim 15, wherein the circuitry is configured to control the first heating element based on first heating parameters, wherein the circuitry is configured to control the second heating element based on second heating parameters, and wherein the first heating parameters are different than the second heating parameters.

21. The apparatus of claim 20, wherein the first heating parameters comprise at least one of the first target temperature, a temperature range, a heating duration, a heating frequency, and a heating control.

22. The apparatus of claim 1, wherein the cartridge and body are detachably coupled by a magnetic connection.

23. The apparatus of claim 1, wherein the cartridge and body are detachably coupled by a snap-fit connection.

24. The apparatus of claim 1, wherein the cartridge and body are detachably coupled by a spring detent connection.

25. The apparatus of claim 1, wherein the cartridge and body are detachably coupled by a compression connection.

26. The apparatus of claim 1, wherein the body comprises a receptacle, wherein the receptacle comprises the first mating connection, and wherein the receptacle comprises the second mating connection.

27. The apparatus of claim 1, wherein the first mating connection is electrically coupled to the first plurality of contacts when the body is detachably coupled to the mating end of the cartridge, and wherein the second mating connection is electrically coupled to the second plurality of contacts when the body is detachably coupled to the mating end of the cartridge.

28. The apparatus of claim 1, wherein the first mating connection comprises a third plurality of contacts, wherein the third plurality of contacts is configured to electrically couple with the first plurality of contacts when the body is detachably coupled to the mating end of the cartridge, wherein the second mating connection comprises a fourth plurality of contacts, and wherein the fourth plurality of contacts is configured to electrically couple with the second plurality of contacts when the body is detachably coupled to the mating end of the cartridge.

29. The apparatus of claim 1, wherein the first plurality of contacts is accessible through an exterior surface of the cartridge, and wherein the second plurality of contacts is accessible through the exterior surface of the cartridge.

* * * * *